US007030550B2

(12) United States Patent
Ide et al.

(10) Patent No.: US 7,030,550 B2
(45) Date of Patent: Apr. 18, 2006

(54) ELECTRON EMISSION DEVICE WITH MULTI-LAYERED FATE ELECTRODE

(75) Inventors: Tetsuya Ide, Kanagawa (JP); Junichi Sawahata, Mie (JP); Masao Urayama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 160 days.

(21) Appl. No.: 10/470,488

(22) PCT Filed: Feb. 1, 2002

(86) PCT No.: PCT/JP02/00850

§ 371 (c)(1),
(2), (4) Date: Jul. 30, 2003

(87) PCT Pub. No.: WO02/061789

PCT Pub. Date: Aug. 8, 2002

(65) Prior Publication Data

US 2004/0090172 A1 May 13, 2004

(30) Foreign Application Priority Data

Feb. 1, 2001 (JP) ..... 2001-025779

(51) Int. Cl.
*H01J 1/02* (2006.01)

(52) U.S. Cl. ..... 313/497; 313/495; 313/446; 313/310; 315/169.1; 315/169.3

(58) Field of Classification Search ..... 313/495–497, 313/336, 310, 309, 351
See application file for complete search history.

(56) References Cited

U.S. PATENT DOCUMENTS 5,489,933 A * 2/1996 Betsui et al. ..... 347/120
5,717,279 A * 2/1998 Imura ..... 313/336
5,850,120 A * 12/1998 Okamoto ..... 313/336
5,889,359 A 3/1999 Seko
6,075,315 A * 6/2000 Seko et al. ..... 313/336
6,204,597 B1 * 3/2001 Xie et al. ..... 313/310
6,437,503 B1 8/2002 Konuma

FOREIGN PATENT DOCUMENTS

JP 5-282990 A 10/1993
JP 7-29484 1/1995
JP 7-161286 6/1995
JP 9-180625 7/1997
JP 9-306396 A 11/1997
JP 11111157 A * 4/1999

(Continued)

OTHER PUBLICATIONS

Uemura et al; "39.3: Carbon Nanotube Fed Elements"; Ise Electronics Corp., Ise, Japan, 1998; 1052-1055.

(Continued)

*Primary Examiner*—Karabi Guharay
*Assistant Examiner*—Sikha Roy
(74) *Attorney, Agent, or Firm*—Nixon & Vanderhye P.C.

(57) ABSTRACT

Low-cost electron emission device and field emission display using a cold cathode electron source having a high electron beam utilization efficiency and capable of controlling the spread of the electron beam. Under the condition Ea≧Eg, the electric field strength near the gate electrode forming an electron emission control unit is varied between a central portion and a peripheral portion in the plane of a single pixel (or sub-pixel), thereby controlling the spread of the electron beam. A device using a field emission-type electron source array capable of achieving a high emission current density at low voltage can be realized at low cost.

9 Claims, 22 Drawing Sheets

FOREIGN PATENT DOCUMENTS

| | | |
|---|---|---|
| JP | 2000-156147 | 6/2000 |
| JP | 2000-243218 | 9/2000 |
| JP | 2000-323011 | 11/2000 |
| JP | 2001-101966 | 4/2001 |
| JP | 2001-160355 | 6/2001 |
| JP | 2001-283714 | 10/2001 |
| WO | 02/27745 A1 | 4/2002 |

OTHER PUBLICATIONS

U.S. Appl. No. 10/381,477, filed Mar. 26, 2003 entitled Cold-Cathode Electron Source and Field Emission Display.

Translation of the International Preliminary Examination Report mailed Nov. 14, 2003 in corresponding PCT Application No. PCT/JP02/00850.

* cited by examiner

ELECTRON EMISSION DEVICE WITH MULTI-LAYERED FATE ELECTRODE

This application is the US national phase of international application PCT/JP02/00850 filed 01 Feb. 2002, which designated the US.

TECHNICAL FIELD

The present invention relates to electron an emission device and field emission display. Particularly, the invention relates to an electron emission display and field emission display capable of improving the utilization efficiency of electron beam.

BACKGROUND ART

There are various kinds of electron emission, such as field electron emission, secondary electron emission, and photoelectron emission, in addition to thermionic emission. A cold cathode is a cathode for producing electron emission by field electron emission. In field electron emission, a strong electric field ($10^9$ V/m) is applied near to the surface of a substance in order to lower the potential barrier of the surface, thus producing electron emission by tunnel effect. The cathode is referred to as a cold cathode because it does not require heating as a hot cathode does.

The current-voltage characteristics of the cold cathode can be approximated by Fowler-Nordheim equation. The electron emitting portion has such a structure (needle-like, for example) that it has a large electric field concentration constant, allowing the application of a strong electric field while maintaining insulation. Earlier cold cathodes had a diode structure and were made by electrolytic polishing of a needle-like single crystal or whisker. In recent years, the micromachining technologies in the fields of integrated circuits and thin films have been applied to the manufacture of field emission-type electron sources (field emitter array) for emitting electrons in a high electric field so successfully that field emitter cold cathodes with extremely small structures are now being made. The field emission-type cold cathode of this type is the most basic electron emission device of all the major components of a micro triode electron tube or a micro electron gun. Due to the structure miniaturization, the cold cathode has such advantages that it can realize a higher current density as an electron source than the hot cathode, and that electron sources which are separated into micro regions can be formed.

Research and development of the field emission-type electron sources are being actively conducted, with the expectations that a field emission display (FED) utilizing the cold cathode can be applied to self-emitting flat panel displays.

Various materials are known for the field emission-type electron source used in FEDs. In order to obtain sufficient electron emission, electric field strength of 1000 V/μm in effective value is required. Thus, when conventional materials are used, the above-mentioned structure is utilized to obtain a large electric field concentration constant, so that values of the actual applied electric field strength can be on the order of 100 V/μm.

In recent years, it has been confirmed that carbon materials such as carbon nanotube can perform electron emission with very small electric field strengths and gaining attention as an electron emission material.

FIG. 1 is a cross sectional view of conventional FED. Numeral 17 designates a face plate, 18 a phosphor, 19 phosphorous emission, 20 a spacer, 21 a back plate, 22 a metal back, and 3 an emitter.

In the FED, as in a CRT, an accelerated electron 6 collides the phosphor 18 and causes it to produce the emission 19, by which an image can be displayed. The face plate 17 is coated with the phosphor 18. As the phosphor material, high-voltage types used for the CRT or the like are the mainstream for the purpose of ensuring luminance. In this case, an aluminum thin film (metal back) 22 is formed on the incident side of the electron beam 6 in order to prevent a chargeup of the phosphor and the ion burning and to increase luminance. The space between the face plate 17 and the back plate 21 is maintained at vacuum. Therefore, the spacers 20 are provided at certain intervals to support the atmospheric pressure and maintain the gap.

FIG. 2 shows cross sections of the structures of conventional emission-type electron sources. Numeral 2 designates a gate insulator film, 3 a field emitter (emitter), 4 a gate electrode, 5 a focusing electrode, 6 emitted electrons (electron trajectories), 7 an equipotential surface, 8 a gate insulator film, 11 an anode electrode, and 14 a cathode wiring.

In any of the emission-type electron sources, a protruding electron emitter 3 is formed on a semiconductor or metal substrate, as shown in FIG. 2(*a*). The gate electrode 4 is formed around the emitter in order to apply an electric field for drawing electrons.

The electrons emitted by the emitter by the application of a voltage to the drawing electrode travel toward the anode 11 formed above the emitter, as shown in FIG. 2(*a*).

In these cold-cathode field emission-type electron sources, a sufficiently high electric field is applied between the gate electrode and the emitter in order to produce electron emission. A positive voltage is applied to the anode to collect the emitted electrons. There is the problem, however, that the emitted electrons spread, as shown by the electron trajectories 6 of FIG. 2(*a*), because the anode-gate electric field is weaker than the gate-emitter electric field.

In the conventional cold-cathode field emission-type electron sources with the projecting electron emitter, the spread of electrons is suppressed by providing the focusing electrode 5 as shown in FIG. 2(*b*), as disclosed in JP Patent Publication (Kokai) No. 7-29484.

In JP Patent No. 2776353, the focusing electrode 5 is provided in the same plane as the gate electrode 4, as shown in FIG. 2(*c*), in order to suppress the spread of electrons. It further proposes providing focusing electrodes on a pixel-by-pixel basis.

JP Patent No. 2625366 proposes making the insulating film thinner near the projecting emitter and thicker at other locations in order to focus the electron beam, as shown in FIG. 4(*a*).

Recently, an electron source structure has been proposed in JP Patent Publication (Kokai) No. 2000-156147, for example, in which, in a field emission-type device comprised of an anode, gate, and emitter as shown in FIG. 2(*d*), electron emission is produced by an anode-emitter field and the electron beam is focused by a gate-emitter electric field. The area of an opening of the focusing electrode is proposed to be smaller than that of the bottom surface of the focusing electrode opening.

Further, JP Patent Publication (Kokai) No. 2000-243218 proposes a structure for a field emission-type device comprising an anode, gate and emitter, as shown in FIG. 2(*e*), in which the anode-gate electric field is stronger than the gate-emitter electric field so that a downwardly protruding equipotential surface can be formed to provide a focusing effect. In this case, the electrons from the emitter are drawn by the electric field from the anode.

When the emission of electrons is caused by the electric field from the anode, it is necessary to employ materials that can emit electrons with a low electron field, such as carbon nanotube as mentioned above, as the material for the field emission-type electron source.

These field emission-type electron sources according to the prior art have the following problems.

In the cold-cathode field emission-type electron source having a projecting electron emitting portion, the focusing electrode 5 is provided to prevent the diffusion of electrons, as shown in FIG. 2(*b*). As a result, the number of manufacturing steps increases and the structure of the device becomes complex.

In the case where, the case not necessarily involving a projecting emitter, a far larger electric field is applied between the gate electrode and the emitter than that at the surrounding areas to produce electron emission and the electrons are focused by a separate focusing electrode, the electrons that have large velocities in diffusing directions are focused, so that greater energy must be dispensed for focusing purposes, thus resulting in reduced efficiency.

Reasons for the poor efficiency are shown in FIG. 3. When a far larger electric field is applied between the gate electrode and the emitter than that at the surrounding areas in order to produce electron emission, the electrons first pass through upwardly protruding equipotential surfaces (diffusing effect) and then downwardly protruding equipotential surfaces (focusing effect), as shown in FIG. 3. Electrons 6 move while they are accelerated in directions perpendicular to equipotential surfaces 7. When an electron passes through an electrostatic lens in which upwardly and downwardly protruding equipotential surfaces of identical shape are formed, as shown in FIG. 3(*a*), the electrons pass through the upwardly protruding equipotential surfaces (diffusing effect) when its initial velocity is slow. Accordingly, in this stage, the electrons receive lateral-direction forces (diffusing effect) for a longer time, so that the diffusing effect is greater. On the other hand, when the electrons pass through the downwardly protruding equipotential surfaces (focusing effect), the electrons have greater velocity and are therefore influenced by the lateral (focusing-direction) force for a shorter time, so that the focusing effect is less. As a result, the electrostatic lens as a whole operates as a diffusing lens (d in<d out).

If the diffusion is to be reduced (d in=d out), the curvature of the downwardly protruding equipotential surfaces (focusing effect) must be made smaller than that of the upwardly protruding equipotential surfaces (diffusing effect), as shown in FIG. 3(*b*). This requires greater energy because a greater potential difference must be created in this region.

In reality, the electric field strength between the gate electrode and the emitter is so great that the upwardly protruding equipotential surfaces become denser. As a result, the electrons possess greater velocities in the diffusing directions, requiring still greater energy for focusing purposes.

In JP Patent No. 2776353, as shown in FIG. 2(*c*), the application of a negative potential to the focusing electrode 5 results in a large potential difference between the focusing electrode and the drawing electrode to which a positive potential is applied, increasing the load on the drive circuit.

In JP Patent No. 2625366, as shown in FIG. 4(*a*), the electrons first pass through upwardly protruding equipotential surfaces (diffusing effect) and then downwardly protruding equipotential surfaces (focusing effect). This results in a reduced focusing effect for the reason mentioned above. Further, if this prior art technique were to be applied to a FED, the potential relationship would be as shown in FIG. 4(*b*), in which the focusing effect is hardly obtained. In order to obtain the focusing effect, the thickness of a thicker portion of the insulating film must be made far greater than that of a thinner portion, which is very difficult.

In the apparatus according to JP Patent Publication (Kokai) No. 2000-156147, the gate electrode is used for focusing the electron beam and, as shown in FIG. 2(*d*), the area of the gate electrode opening is made larger than that of the gate opening bottom surface. This makes it difficult to completely suppress the electric field from the anode, and also complicates the manufacturing steps.

In the apparatus known from JP Patent Publication (Kokai) No. 2000-243218, as shown in FIG. 2(*e*), the gate electrode doubles as the electron-beam focusing electrode. While this can simplify the manufacturing process, the spot size of the electron beam emitted by the electron source on the anode surface (phosphor surface) is determined by the ratio between the anode-emitter electric field strength Ea and the gate-emitter electric field strength Eg. In the following, the relationship between the electric field strengths Ea and Eg will be discussed.

When the value of Eg is too small as compared with the value of Ea, the electron-beam focusing effect of the gate electrode would be too strong, so that the spot size would be larger than the gate opening diameter before the beam arrives at the anode surface after having been focused in front of the anode surface. This would lead to crosstalk and thus reduce the image quality.

In an FED utilizing the high-voltage type phosphor mentioned above, there is a lower limit value for the anode potential for ensuring luminance (for ensuring phosphor emission efficiency, metal-backed layer transmission). The distance between the face plate and the back plate should desirably be small from the viewpoint of the shape of the spacer (aspect ratio) and the prevention of the diffusion of electron beam. The distance, however, should be large from the viewpoint of maintenance of the insulator withstand voltage. In view of such a tradeoff, currently the lower limit value of the anode voltage is set to be on the order of 5 kV, and the distance between the face plate and the backplate is set to be on the order of 1 mm, and the anode-emitter electric field strength Ea of the order of 5 V/μm is used.

When carbon nanotube is used as the electron emission material, necessary current densities for the FED can be obtained with the gate-emitter field strength Eg on the order of 2 V/μm.

FIG. 5 shows a cross sectional view illustrating how the electron beam spread in the configuration of FIG. 2(*e*).

As shown in FIG. 5, the spot size on the anode surface becomes larger than the gate opening diameter, and the condition is such that Eg is too small with respect to Ea. When Ea is 5 V/μm in the above-mentioned configuration, the condition Eg≧3 V/μm is necessary so that the spot size on the anode surface is to be no larger than the gate opening diameter.

The spot size can be reduced by sacrificing the electron emission characteristics and increasing the value of Eg. This, however, will result in applying a high electric field in a minute region between the gate and the emitter, which increases the danger of dielectric breakdown due to surface creepage on the insulator film, for example.

The present applicant has filed JP Patent Application No. 11-214976 (1999) concerning a cold-cathode electron source in which the emitter is divided on a pixel-by-pixel (or subpixel-by-subpixel) basis and in which a plurality of gate openings are provided so that the influence of an increase in the spot size at the center of the pixels can be prevented.

FIG. 6 shows a cross-sectional view illustrating how the electron beam spread in the above-mentioned divided gate/emitter configuration. In FIG. 6, numeral 1 designates a substrate, 2 a gate insulating film, 3 an emitter, 4 a gate electrode, 6 emitted electrons, 14 a cathode wiring, and 15 a ballast resistor layer.

As described in JP Patent Application No. 11-214976 (1999), the influence of spot size increases at the center of the pixels can be prevented by dividing the emitter on a pixel-by-pixel (or subpixel-by-subpixel) basis and providing a plurality of gate openings. However, as shown in FIG. 6, the spots of the electron beams emitted via the gate openings formed on the periphery of the pixels still spread beyond the pixel region, similarly causing crosstalk.

In view of these problems of the prior art, it is the object of the invention to provide at low cost an electron emission device and a FED comprising a cold-cathode electron source that has a high utilization efficiency of electron beam and that is capable of suppressing the spread of electron beam.

SUMMARY OF THE INVENTION

The invention provides an electron emission device comprising: a gate electrode formed on a substrate via an insulating film; an emitter formed in a gate opening provided through the insulating film and the gate electrode; and an anode electrode disposed away from the emitter with a predetermined distance, wherein the gate electrode comprises at least two kinds of gate electrodes including a first gate electrode made of a first material and a second gate electrode formed closer to the anode electrode than the first gate electrode and made of a second material, and wherein the diameter of the opening of the second gate electrode is larger than that of the opening of the first gate electrode continuously or discontinuously.

The invention provides an electron emission device comprising: a gate electrode formed on a substrate via an insulating film; an emitter formed in a gate opening provided through the insulating film and the gate electrode; and an anode electrode disposed away from the emitter with a predetermined distance, wherein the insulating film comprises at least two kinds of insulating films including a first insulating film made of a first material and a second insulating film formed closer to the anode electrode than the first gate electrode and made of a second material, and wherein the diameter of the opening of the second insulating film is larger than that of the opening of the first insulating film continuously or discontinuously, and wherein the gate electrode is formed at the opening of the first insulating film and the opening of the second insulating film continuously.

The invention provides an electron emission device comprising: a gate electrode formed on a substrate via an insulating film; an emitter formed in a gate opening provided through the insulating film and the gate electrode; and an anode electrode disposed away from the emitter with a predetermined distance, wherein the gate electrode comprises a first gate electrode region having a first opening diameter and a second gate electrode region having a second opening diameter, wherein the second opening diameter is larger than the first opening diameter continuously or discontinuously, and wherein, when a potential difference is provided between the gate electrode and the emitter, an upwardly protruding equipotential surface in the direction from the emitter to the anode electrode, and a downwardly protruding equipotential surface are formed near the first gate opening region.

By thus providing a step structure in the gate electrode, at least two different distances can be easily provided between the surface of the emitter and the gate opening, so that the spread of the electron beam can be controlled.

Preferably, the center of opening of the first layer of the gate electrode is made to coincide with the center of opening of the second layer of the gate electrode. In this way, the beam can receive a uniform focusing effect, so that the distortion in the spot shape or the displacement of the beam position on the anode surface in an intra-plane direction can be prevented.

Further preferably, by following the condition $Ea \geqq Eg$, the gate electrode can be made function as a focusing electrode as well, so that the need to provide a separate focusing electrode can be eliminated and the manufacturing process can be simplified. At the same time, the amount of gate current that results in loss can be reduced, and the spread of the electron beam can be controlled regardless of the ratio between Ea and Eg.

Further preferably, by making the ratio of gate opening width/gate height equal to or smaller than 5/3, the amount of electron emission can be sufficiently controlled, as disclosed in JP Patent Application No. 2000-296787.

The invention provides an electron emission device comprising: a gate electrode formed on a substrate via an insulating film; a plurality of emitters formed in a plurality of gate openings provided through the insulating film and the gate electrode for each pixel; and an anode electrode disposed away from the plurality of emitters with a predetermined distance, wherein the gate electrode has such a structure that it projects toward the anode electrode at an outer-most peripheral portion surrounding the plurality of emitters.

Thus, by providing a plurality of gate electrode first-layer openings in a single pixel, the influence of the spread of the electron beam is due only to the electrons emitted toward the outside of the pixel via a gate electrode second layer opening formed on the peripheral portion. Further, in this case, the gate-emitter distance can be reduced while maintaining the condition gate opening width/gate height $\leqq 5/3$ as disclosed in JP Patent Application 2000-296787. Thus, the spread of the electron beam can be better controlled, and the drive voltage can be lowered while maintaining the effect of controlling the amount of electrons emitted.

The invention provides an electron emission device comprising: a gate electrode formed on a substrate via an insulating film; a plurality of emitters formed in a plurality of gate openings provided through the insulating film and the gate electrode for each pixel; and an anode electrode disposed away from the plurality of emitters with a predetermined distance, wherein the second gate electrode is disposed at a central portion of the pixel, and the first gate electrode is disposed at a peripheral portion surrounding the central portion.

The invention provides an electron emission device comprising: a gate electrode formed on a substrate via an insulating film; a plurality of emitters formed in a plurality of gate openings provided through the insulating film and the gate electrode for each pixel; and an anode electrode disposed away from the plurality of emitters with a predetermined distance, wherein the second gate electrode is disposed at a central portion of the pixel, and the first gate electrode is disposed at a peripheral portion surrounding the central portion, and the second gate electrode is disposed at a region surrounding the first gate electrode.

The invention provides an electron emission device comprising: a gate electrode formed on a substrate via an insulating film; a gate opening provided through the insulating film and the gate electrode; an emitter formed in the gate opening; and an anode electrode disposed away from the emitter by a predetermined distance, wherein the gate electrode comprises a first gate electrode region surrounding the gate opening and a plurality of the emitter and having a first height, and a second gate electrode surrounding the first gate electrode region and having a second height higher than the first height.

Thus, the spread of the electron beam can be better controlled and, at the same time, the effect of controlling the amount of electrons emitted at the pixel central portion, where the current density is high, can be enhanced during the control of the amount of electron emission, so that the black floating on the display apparatus can be prevented.

Preferably, when a potential difference is provided between the gate electrode and the emitter, an upwardly protruding equipotential surface that does not extend beyond the first height toward the anode electrode is formed, and a downwardly protruding equipotential surface is formed between the first and the second height, in the gate opening.

Preferably, the gate electrode further comprises a third gate electrode region having the first height.

The invention provides an electron emission device comprising: a gate electrode formed on a substrate via an insulating film; a plurality of gate openings provided through the insulating film and the gate electrode; a plurality of emitters provided in the gate opening and forming a pixel; and an anode electrode disposed away from the emitters by a predetermined distance, wherein the gate electrode comprises a first gate electrode region having a first height, and a second gate electrode region located more toward the pixel center than the first gate electrode region, the second gate electrode having a plurality of the gate openings and having a second height higher than the first height.

Preferably, the potential applied between the emitter and the second gate electrode region is smaller than the potential applied between the emitter and the first gate electrode region.

Preferably, the potential applied between the emitter and the third gate electrode region is smaller than the potential applied between the emitter and the second gate electrode region.

Preferably, the plurality of emitters have an intra-plane distribution within the pixel. Thus, the electron beam can be made uniform within the pixel and the probability of dielectric breakdown between the emitter and the gate can be reduced.

Preferably, a ballast resistor layer is formed so that the variance of the amount of electron emission due to differences in electric field strengths can be controlled and the electron beam can be made uniform within the pixel.

Further preferably, the emitter is divided during the formation of the ballast resistor layer, as disclosed in JP Patent Application No. 11-214976, so that the spread of the current into the emitter plane can be prevented and the uniformity of the electron beam within the pixel can be further improved.

Further preferably, a material that emits electrons at electric field strengths of not more than 10 V/μm may be used so that dielectric breakdown due to discharge or the like can be prevented.

The invention further provides a field emission display comprising the above-described electron emission device, wherein the electron emission device is formed in a two-dimensional matrix.

This specification includes part or all of the contents as disclosed in the specification and/or drawings of Japanese Patent Application No. 2001-25779, which is a priority document of the present application.

BRIEF DESCRIPTION OF THE DRAWINGS

FIG. 7(*b*) is a cross sectional view of a field emission-type electron source according to the present invention, showing the equipotential surfaces formed during the emission of electrons.

BEST MODE OF CARRYING OUT THE INVENTION

Figure 1:
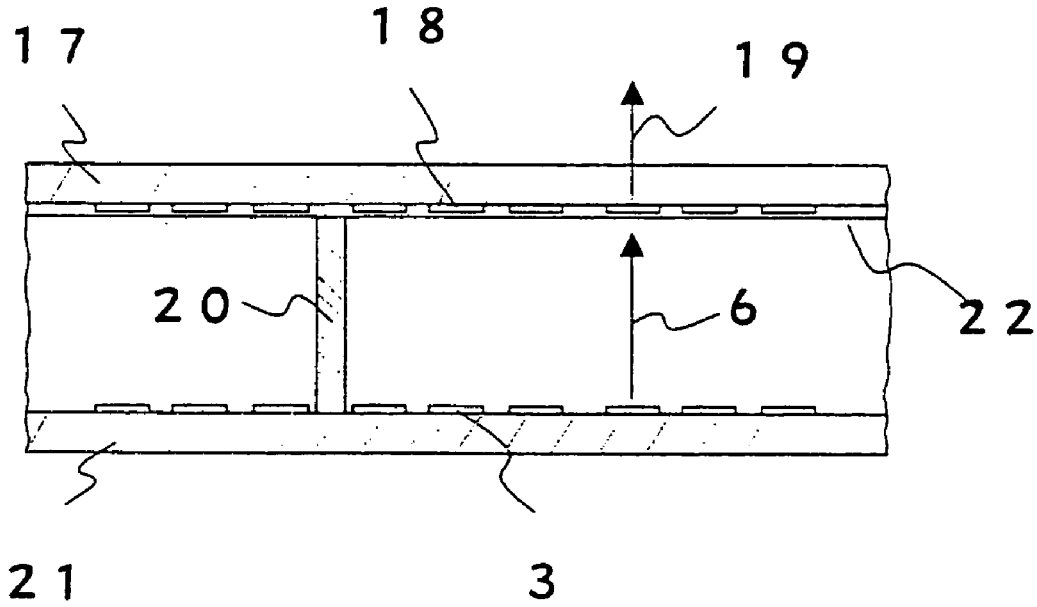
FIG.1 (Prior Art)
FIG. 1 is a cross sectional view of a field emission display according to the prior art.
Figure 2A:
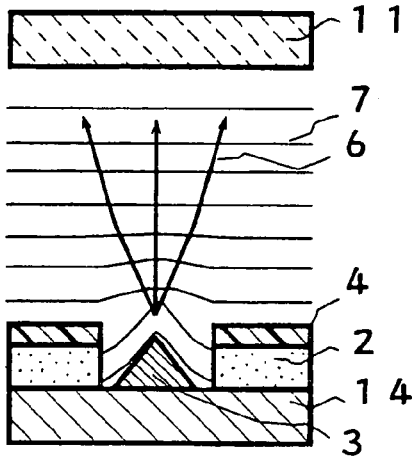
Prior Art FIG.2A
FIG. 2 shows cross sections of the structure of a field emission-type electron source according to the prior art.
Figure 2D:
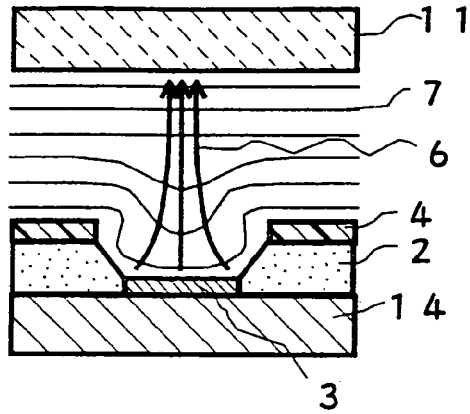
Figure 2B:
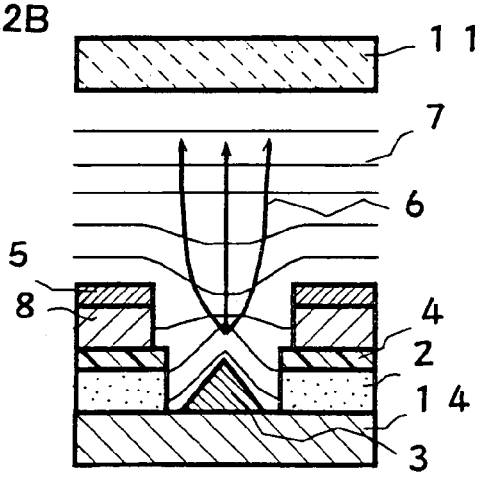
Figure 2E:
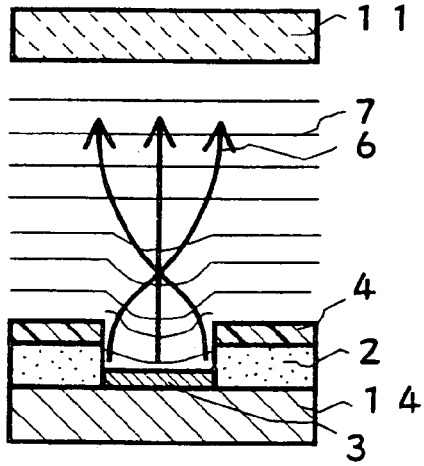
Figure 2C:
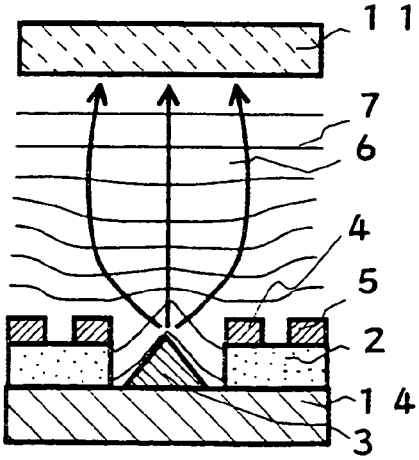
Figure 3A:
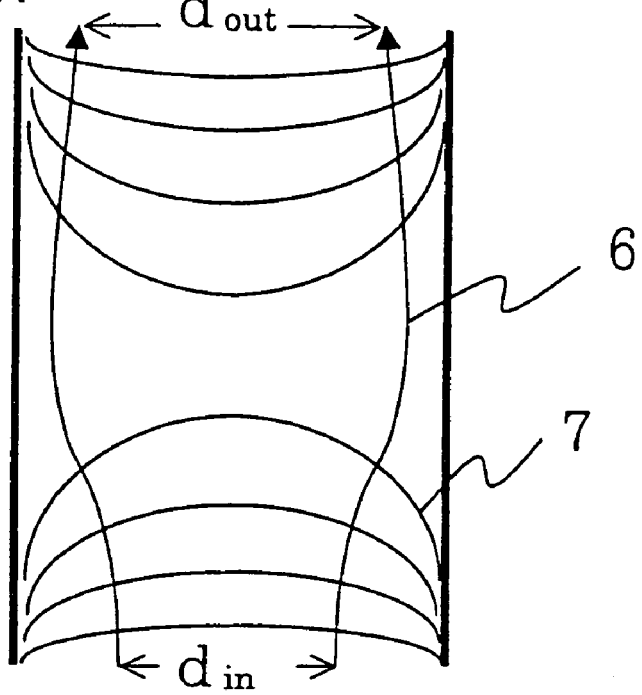
FIG.3A (Prior Art)
FIG. 3 shows cross sections of the conventional field emission-type electron source, illustrating the electrostatic lens formed by an upwardly and a downwardly protruding equipotential surface, and the movement of electrons in it.
Figure 3B:
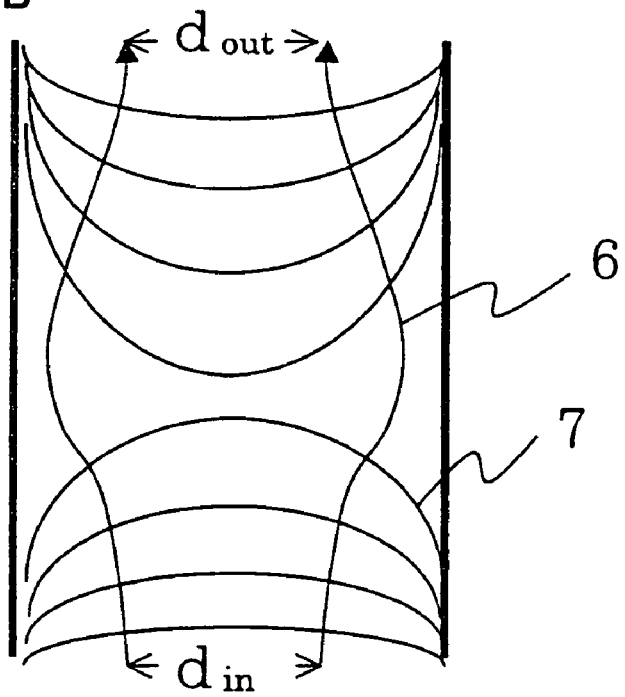
FIG.3B (Prior Art)
Figure 4A:
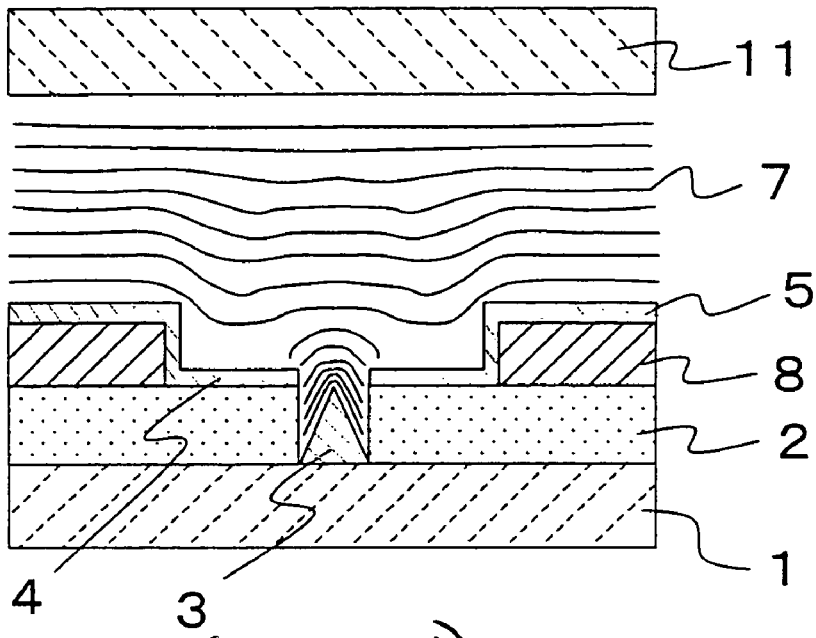
FIG.4A (Prior Art)
FIG. 4 shows cross sections of the structure of a field emission-type electron source according to the prior art, showing the equipotential surfaces formed during the emission of electrons.
Figure 4B:
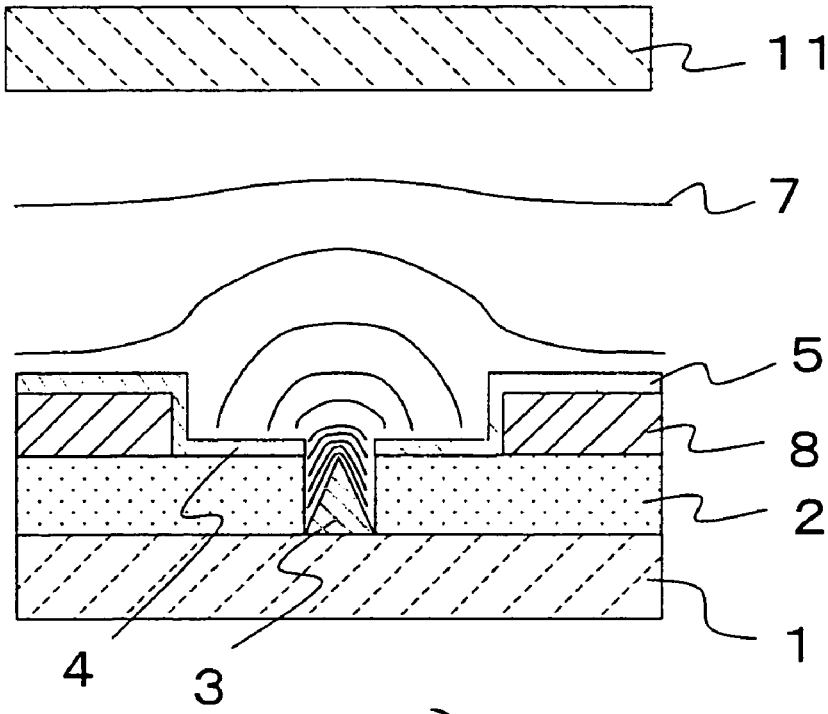
FIG.4B (Prior Art)
Figure 5:
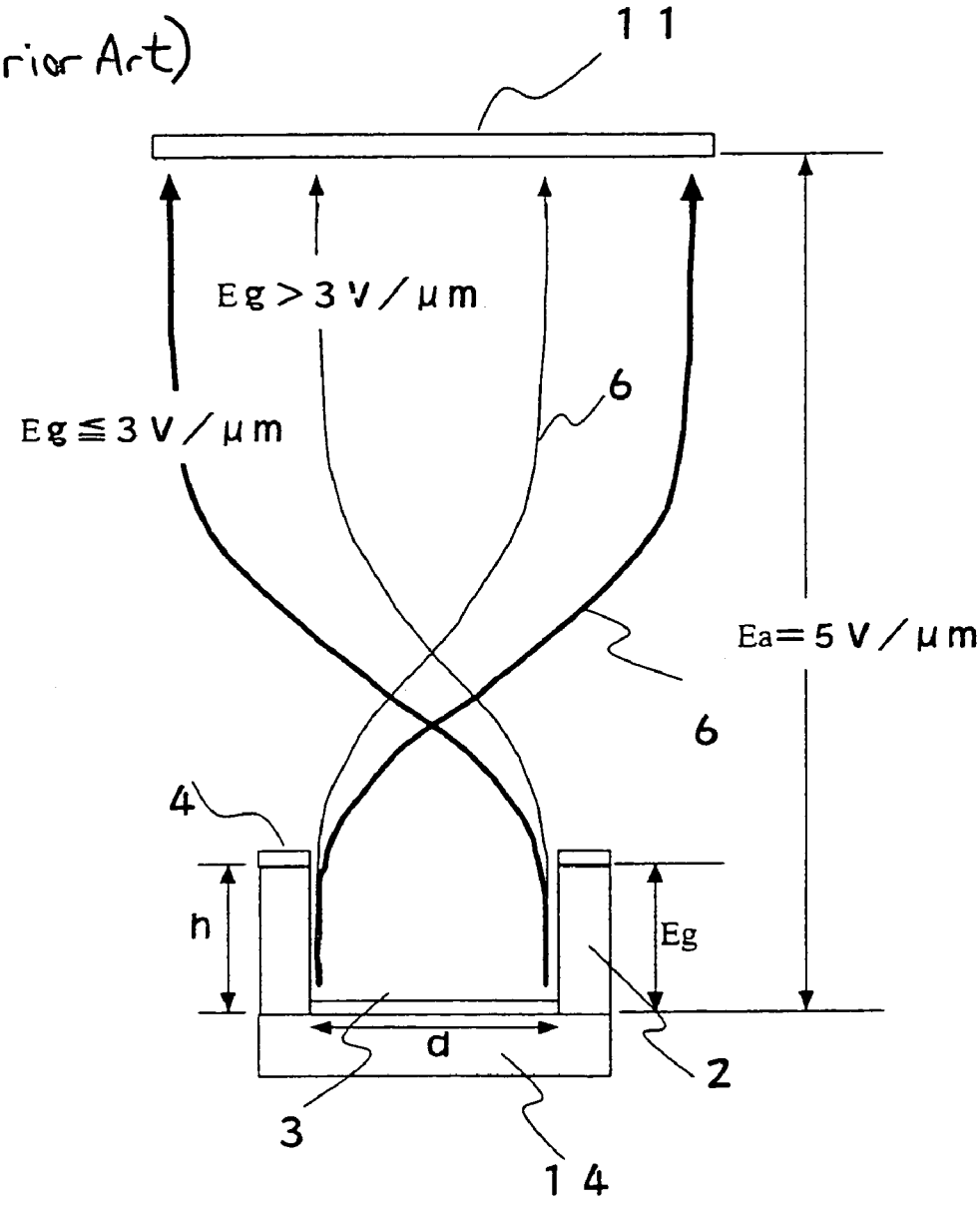
FIG.5 (Prior Art)
FIG. 5 is a cross sectional view of the conventional field emission-type electron source, illustrating the spread of the electron beam.
Figure 6:
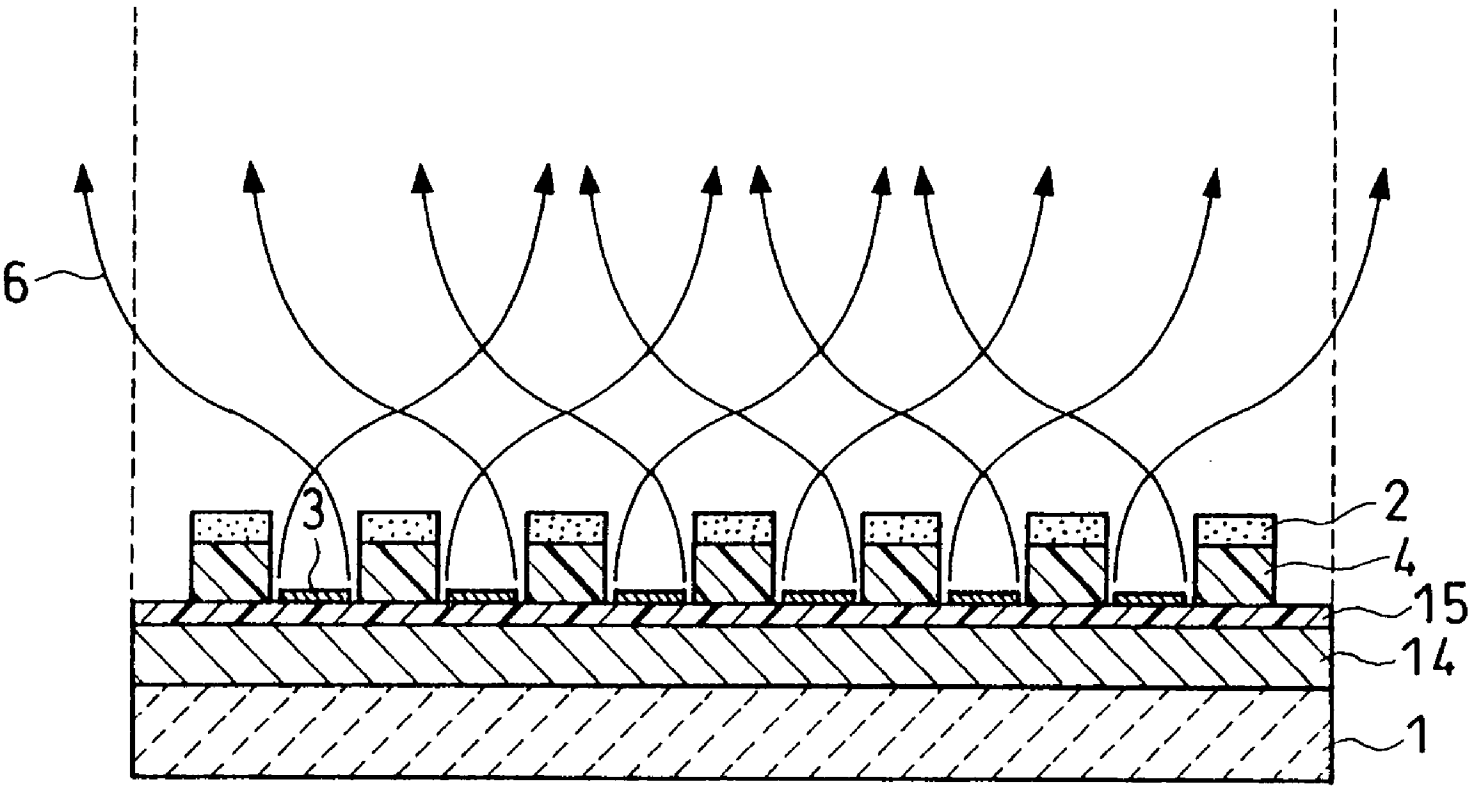
FIG.6 (Prior Art)
FIG. 6 is a cross sectional view of the conventional field emission-type electron source, illustrating the spread of the electron beam.

Embodiments of the invention will be hereafter described in detail by referring to the drawings.

The basic concept of the invention is as follows.

The invention provides an electron emission device used in a display apparatus for displaying a plurality of pixels using an electron beam. The electron emission device includes an electron emitter unit and an electron emission amount control unit. The electron emission device is configured such that the electric field strength near the electron emission control unit is varied at a center portion and a peripheral portion of each pixel (or each sub-pixel) so that the diffusion of the electron beam can be controlled.

Preferably, a condition $Ea \geqq Eg$ is adopted so that the gate electrode can function as a focusing electrode, thereby eliminating the need to provide a separated focusing electrode and simplifying the manufacturing process. At the same time, the amount of gate current that results in a loss can be reduced, so that the spread of the electron beam can be controlled regardless of the ratio between Ea and Eg.

Figure 7A:
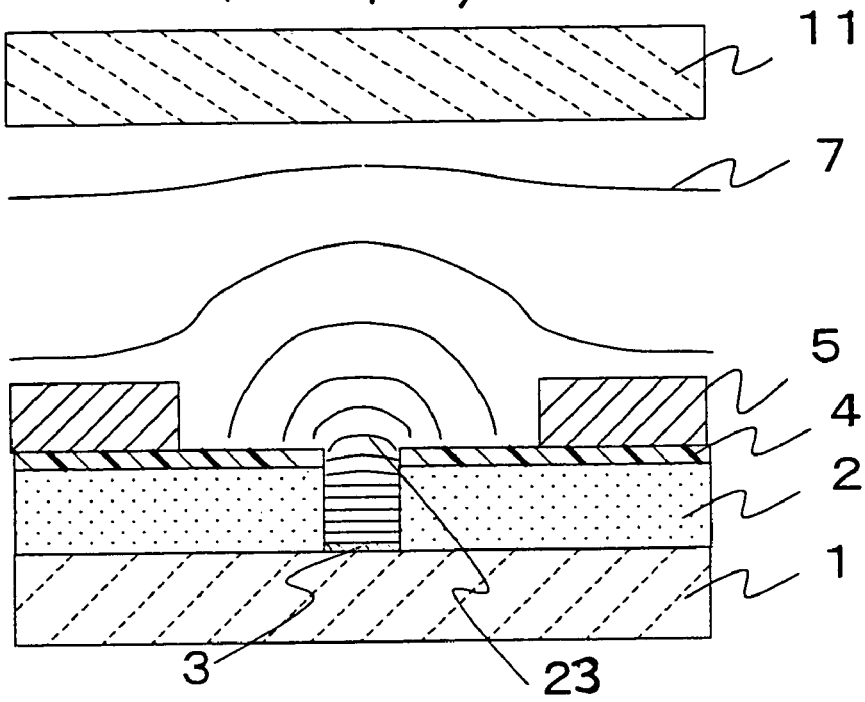
FIG.7A (Prior Art)
FIG. 7(*a*) is a cross sectional view of a field emission-type electron source according to the prior art, showing the equipotential surfaces formed during the emission of electrons.
Figure 7B:
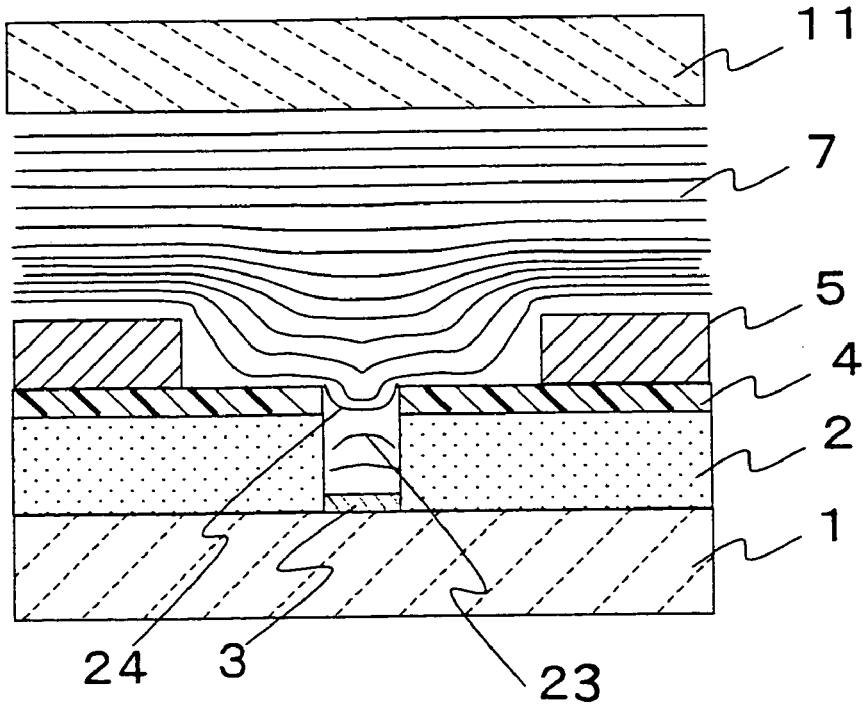

When a positive potential applied to the gate is varied to control the amount of electron emission from the emitter, with the anode-emitter electric field strength being set larger than the gate-emitter electric field strength, an upwardly protruding equipotential surface 23 is formed between the gate and the emitter by the positive potential at the gate, as shown in FIG. 7(*b*). In the vicinity of the gate opening portion, the electric field from the anode enters, creating a downwardly protruding equipotential surface 24. Thus, the upwardly protruding equipotential surface 23 does not project beyond the gate electrode position toward the anode.

When the amount of electron emission from the emitter is controlled by varying the positive potential applied to the gate, with the anode-emitter electric field strength being smaller than the gate-emitter electric field strength, as in the conventional cold-cathode electron source, an upwardly protruding equipotential surface 23 is formed as shown in FIG. 7(*a*). At the same time, as the electric field created by the anode is weak, the upwardly protruding equipotential surface projects beyond the gate electrode position toward the anode.

In the following, the embodiments of the invention will be described along the above-described basic concept of the invention. A first and a second embodiment of the invention has a structure in which the distance between the gate electrode and the electron emitting portion is not constant by providing steps to the gate electrode, so that the electric field strength varies between a central portion and a peripheral portion.

First Embodiment

Figure 8:
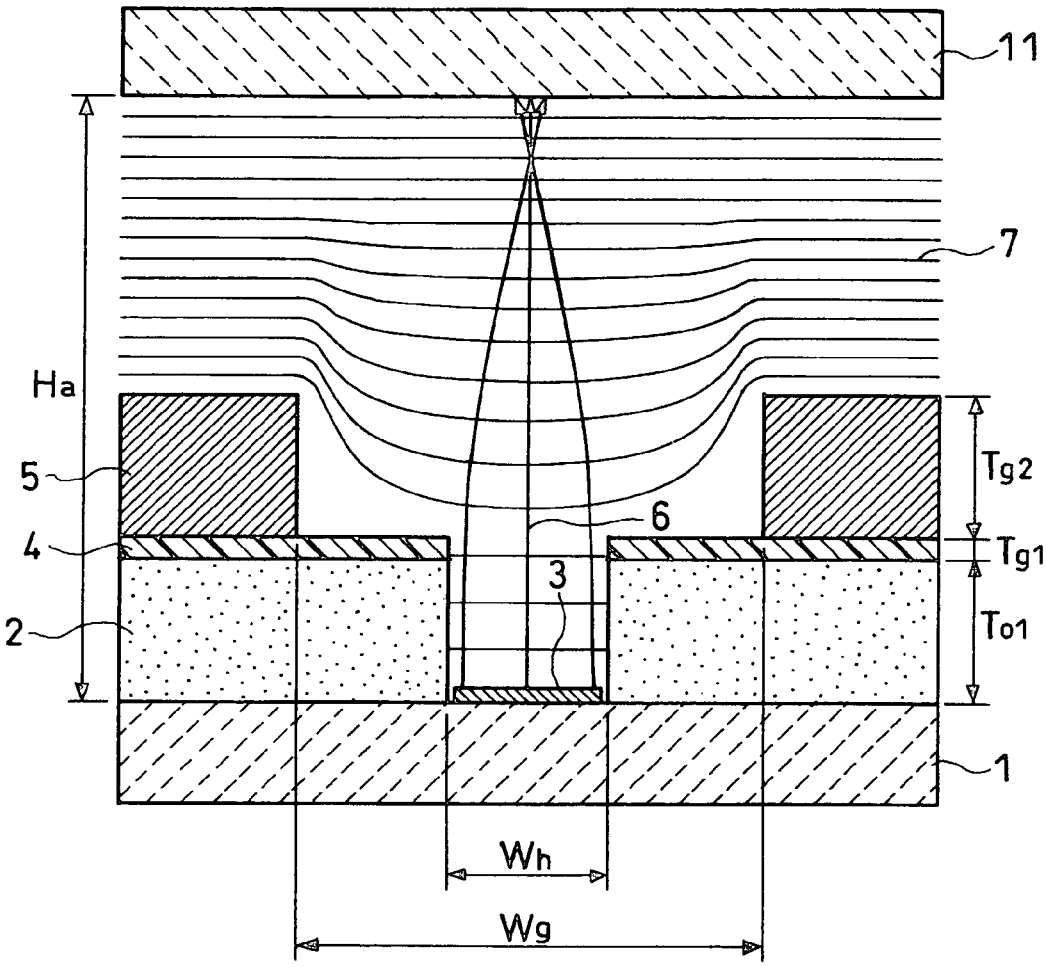
FIG. 8 is a cross sectional view of the structure of the electron emission device according to a first embodiment of the invention.
Figure 9A:
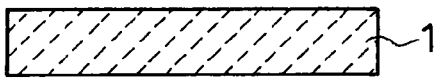
FIG. 9 shows cross sections illustrating the manufacturing process for the electron emission device according to the present embodiment.
Figure 9B:
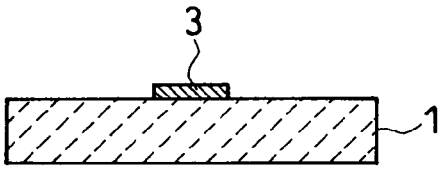
Figure 9C:
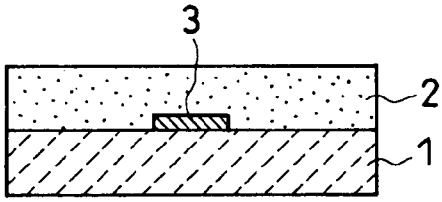
Figure 9D:
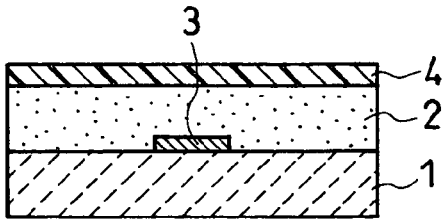
Figure 9E:
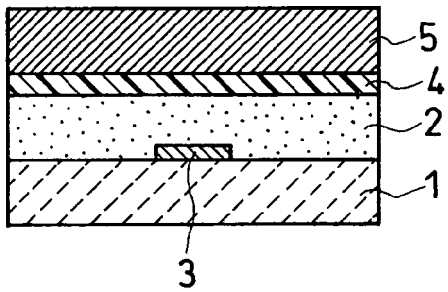
Figure 9F:
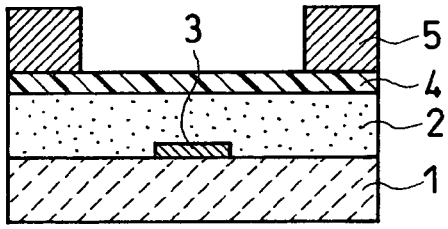
Figure 9G:
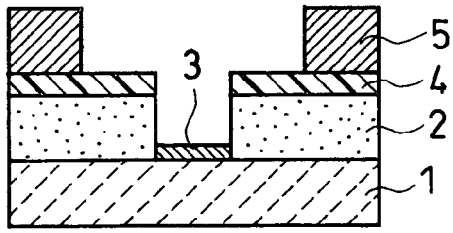

FIG. 8 is a cross sectional view illustrating the configuration of an electron emission device according to the first embodiment of the invention. In the following description of the first embodiment, constituent elements or parts similar to those shown in FIGS. 2 to 6 are designated with similar reference numerals or signs.

The electron emission device according to the present embodiment is a cold-cathode field emission-type electron source comprising a stacked structure comprising a substrate, a gate insulating film, and a gate metal. A hole (opening) is provided through the gate metal and the gate insulating film. An emitter is provided at a bottom layer of the hole.

In FIG. 8, numeral 1 designates the substrate, 2 the gate insulating film, 3 an electron emitting portion (emitter), and 4 a first gate electrode layer made of Cu (a first metal) having an opening width Wh and a film thickness of Tg1. Numeral 5 designates a second layer of the gate electrode made of Al (a second metal) having an opening width Wg and a film thickness of Tg2 (wherein $Wh<Wg$, $Tg1 \ll Tg2$). Numeral 6 designates an emitted electron (electron trajectory), 7 an equipotential surface, and 11 an anode electrode.

The first and second layers of the gate electrode 4 and 5 have different opening widths ($Wh<Wg$) at least near the electron emission control unit, thus providing the gate electrode with a stepped structure.

In the present embodiment, the film thicknesses are also greatly different ($Tg1 \ll Tg2$), so that the step in the gate electrode is pronounced. The first layer 4 and the second layer 5 of the gate electrode constitute a control electrode and a focusing electrode as a whole. In the present embodiment, two kinds of metal materials are used in the gate electrode and the step is formed in the gate electrode, so that the electric field strength near the gate electrode (electron emission control unit) is varied between a center portion and a peripheral portion of each pixel (or each sub-pixel). For example, when a film thickness To1 of the gate insulating film 2 is 3 μm, the film thickness Tg1 of the first layer 4 of the gate electrode is 5000 Å, the film thickness Tg2 of the second layer 5 of the gate electrode is 3 μm, the opening width Wh of the first layer 4 of the gate electrode is 3 μm, the opening width Wg of the second layer 5 of the gate electrode is 9 μm, an emitter-anode distance Ha is 1 mm, a gate ON voltage is 3 V, and an anode voltage is 5000 V, the spot size of the electron beam will be 19.46 μm, which is 28.8% smaller than the spot size, 27.33 μm, of the electron beam in the case where the second layer 5 of the gate electrode is absent.

Two types of metal materials are used in the gate electrode for the following reasons. By providing the first and the second gate electrode layers with different properties, the heating of the gate electrode due to the flow of the gate current and the abnormal discharge or the like due to the generation of gas resulting from the collision of electrons or ions can be prevented. This way, the electron emission stability and the anti-emitter destruction property can be enhanced and, furthermore, the step in the gate electrode can be more accurately formed. As there is a possibility that part of the electrons emitted by the emitter enters the first gate electrode (the first gate electrode layer), it is necessary to laminate metal materials with low resistance one upon another. Examples of the materials include Cu and Al.

As to the second gate electrode (the second layer of the gate electrode), a high melting-point metal should preferably be used in order to prevent the generation of discharge due to the generation of gas during electron emission, in light of a rise in the discharge occurring voltage between the anode and the gate. Preferably, metal materials other than high melting-point metals may be laminated that emit only a little amount of gas (i.e., that are less liable to produce gas) so that the deterioration of vacuum due to the emission of gas can be prevented. Concrete examples of such materials include high melting-point metals such as W, Mo and Nb, and iron alloys such as Al and SUS. In the case of Al material, as it can be used in the first gate electrode layer, care should be taken not to use the same material in both the first and second layers.

Hereafter an example of the method of manufacturing the electron emission device according to the first embodiment will be described.

FIG. 9 shows cross sections concerning the individual steps of the method of manufacturing the electron emission device. FIG. 9 only schematically shows the manufacturing process, and a manufacturing system for the present process may be constructed in an appropriate manner taking productivity or the like into consideration.

In FIG. 9(*a*), Al is deposited on a substrate 1 by a CVD method to form an emitter electrode. In FIG. 9(*b*), an emitter electrode is patterned by photolithography.

In FIG. 9(*c*), a gate insulating film 2 with a thickness 3 μm is formed using a SOG (Spin On Glass) technique.

Then, a first layer 4 of the gate electrode is deposited to a thickness of 5000 Å by vapor depositing or sputtering Cu, as shown in FIG. 9(*d*).

Then, a second layer 5 of the gate electrode is deposited to a thickness of 3 μm by vapor depositing or sputtering Al, as shown in FIG. 9(*e*).

Then, a step is formed in the gate electrode by forming an opening with a width of 9 μm by etching the second layer 5 of the gate electrode, as shown in FIG. 9(*f*).

Then, as shown in FIG. 9(*g*), the first layer 4 of the gate electrode is etched at the center of the opening formed by the etching of the second layer 5 of the gate electrode to form an opening with a width of 3 μm. Further, the gate insulating film 2 is etched with buffered hydrofluoric acid until the emitter 3 appears. The emitter 3 is not etched by buffered hydrofluoric acid, thus acting as an etch stopper. By the steps so far described, the electron emission device is completed.

The gate electrode may be formed by electrolytic plating or MOCVD (Metal Organic Chemical Vapor Deposition), as well as by vapor deposition or sputtering.

As described above, the electron emission device according to the first embodiment has such a structure that a step is formed in the gate electrode using two kinds of metal so that the electric field strength varies near the electron emission control unit between the center portion and the peripheral portion in each pixel. Thus, the spread of the electron beam can be controlled, as will be seen by comparing FIGS. 8 and 2(*e*). Accordingly, a device using the field emission-type electron source array capable of achieving a high emission electron density at low voltages can be realized at low cost.

By increasing the thickness of the first gate electrode region, the effect of preventing the entry of the electric field produced by the anode electrode potential into the emitter surface can be enhanced, so that the effect of controlling the electron emission amount can be enhanced.

However, in the case where the amount of electron emission is controlled by changing the positive potential applied to the gate electrode, if the film thickness of the first gate electrode region is increased too much, the amount of electrons flowing into the gate will increase and result in loss.

Figure 10A:
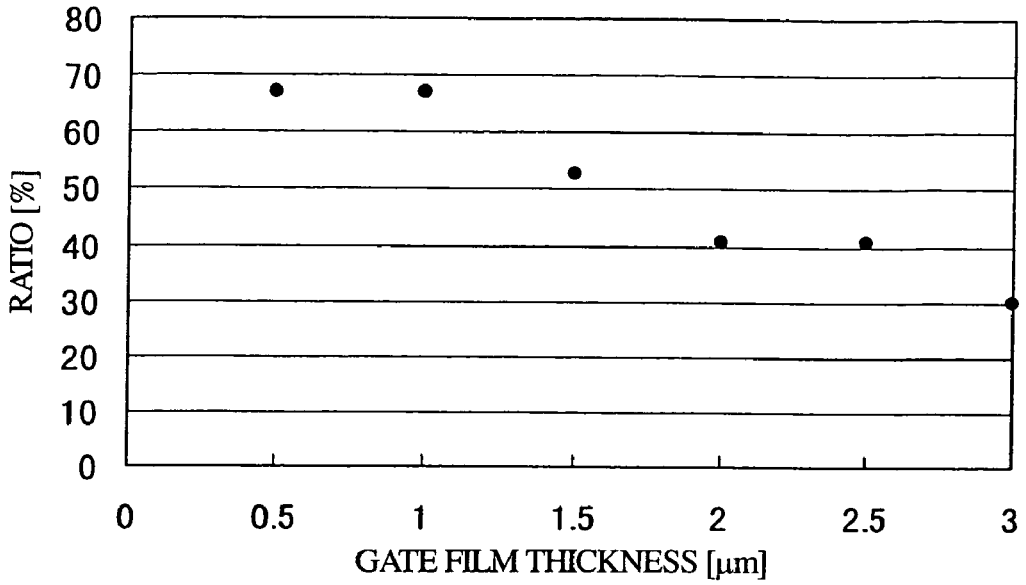
FIG. 10 shows charts illustrating the ratio of the area of the emitter from which an electron beam is emitted that can pass through the gate to the area of the gate opening, in the case where the gate electrode film thickness of a first gate region is varied.
Figure 10B:
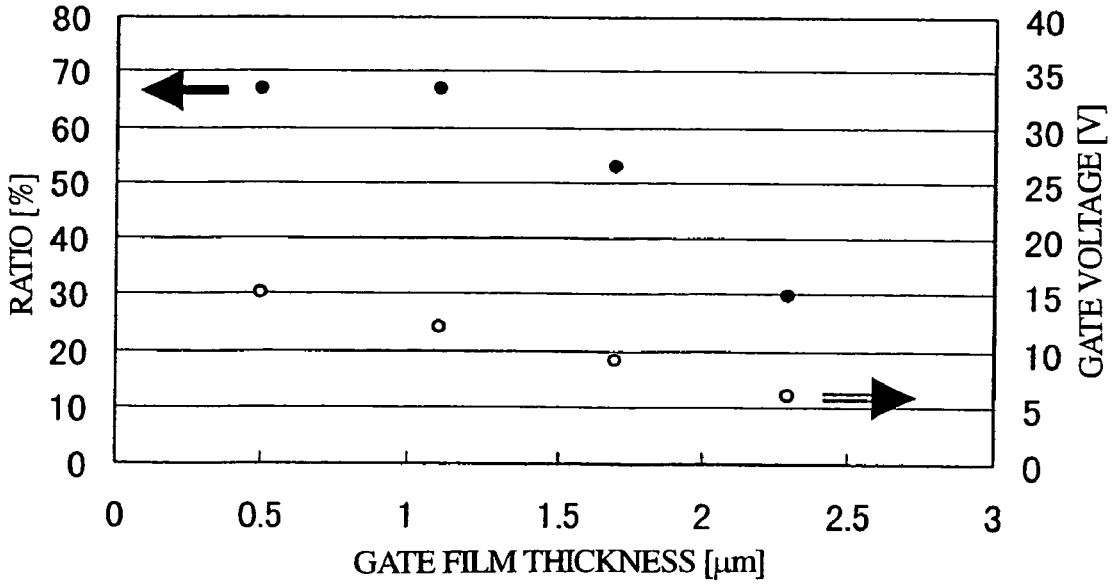

FIG. 10 shows the results of estimating the loss by simulating the electric fields. The simulation concerned the case where the anode-emitter electric field strength Ea is 7.5 V/μm, the gate-emitter electric field strength Eg is 5 V/μm, and the gate opening width Wh in FIG. 8 is 5 μm, and electron trajectory calculations were made assuming that electrons are emitted from each of 11 concentric portions obtained by equally dividing the emitter region from the center.

FIG. 10(*a*) shows the ratio of the area of the emitter from which an electron beam is emitted that can pass through the gate to the area of the gate opening, as the gate electrode film thickness is varied while maintaining the gate insulating film thickness T01 of FIG. 8 at 3 μm.

FIG. 10(*b*) shows the ratio of the area of the emitter from which an electron beam is emitted that can pass through the gate to the area of the gate opening, as the gate electrode film thickness Tg1 is varied while maintaining the sum of the gate insulating film thickness T01 and the film thickness Tg1 of the first gate region shown in FIG. 8 at a constant value of 3 μm.

In this case, the distance between the gate and the emitter decreases with increasing film thickness Tg1. Thus, in order to maintain the value of the gate-emitter electric field strength at a constant value (5 V/μm), the potential applied to the gate decreases. As a result, the drive voltage on the drive plane can be lowered. Thus, these results indicate that it is preferable to dispose the emitter region at the center of the gate opening and set its width We such that $We \leqq 0.8 \times Wh$, because, when a positive potential is applied to the gate electrode, the electrons around the emitter flow into the gate electrode.

Further, the film thickness Tg1 in the first gate region should preferably be set to such a value as to satisfy the relationship Wh/Tg1>5/1.5 with respect to the gate opening width.

Further, as the first and second gate electrode layers are provided with different properties, the heating of the gate electrode due to the flow of the gate current, and the abnormal discharge due to the generation of gas by collisions of electrons, for example, can be prevented, so that the electron emission stability and the anti-emitter destruction property can be enhanced.

Second Embodiment

Figure 11:
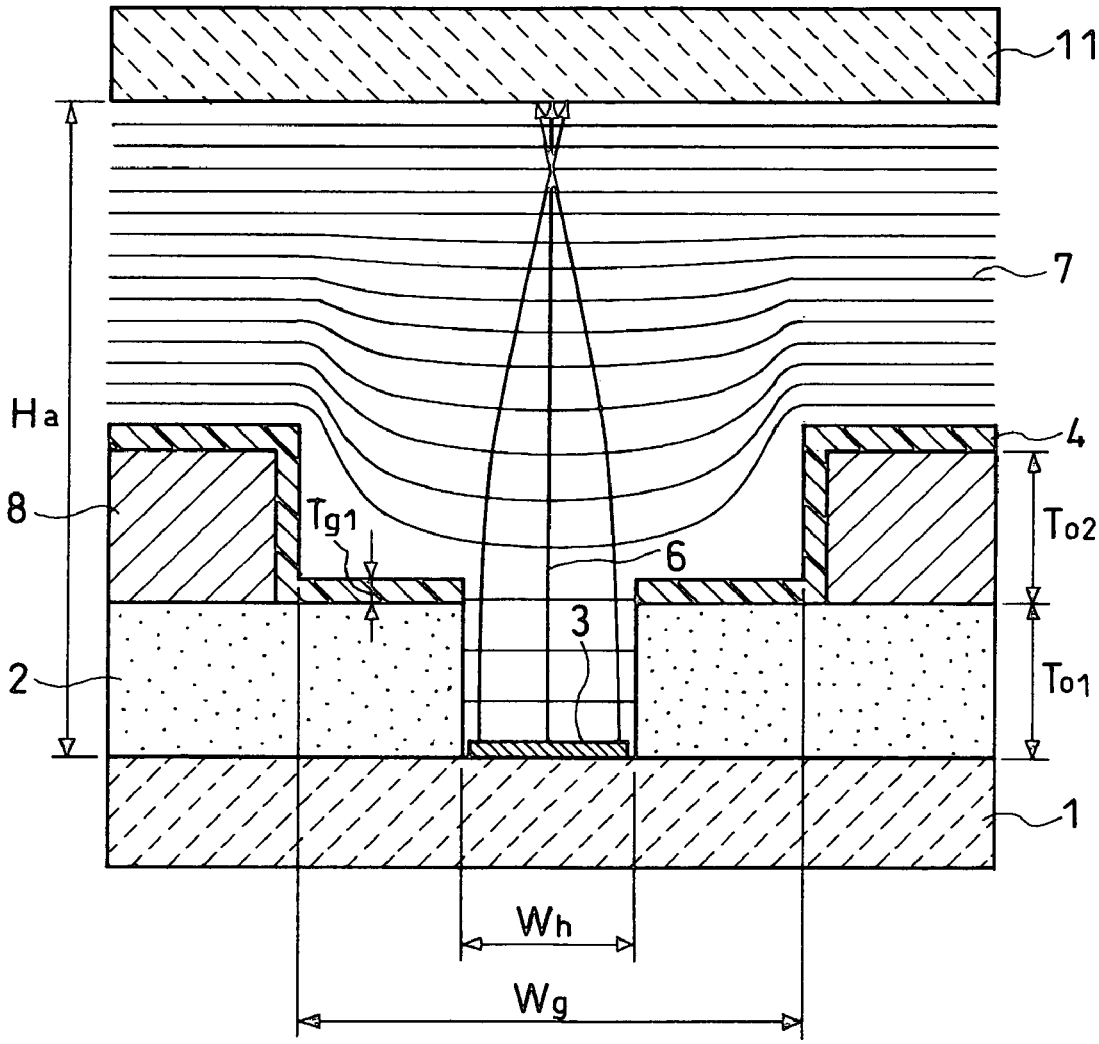
FIG. 11 is a cross sectional view of the electron emission device according to a second embodiment of the invention.
Figure 12A:
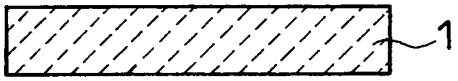
FIG. 12 shows cross sections illustrating the manufacturing process for the electron emission device according to the present embodiment.
Figure 12B:
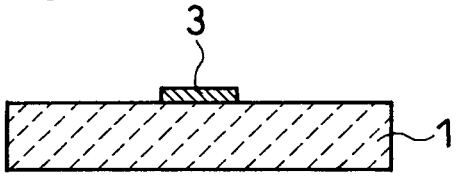
Figure 12C:
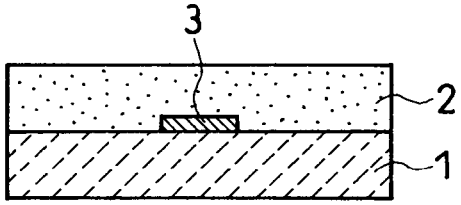
Figure 12D:
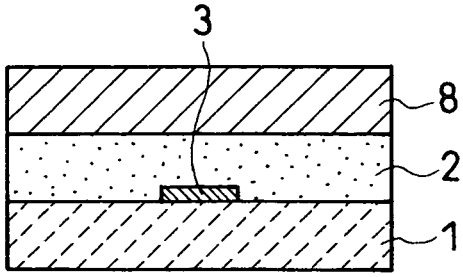
Figure 12E:
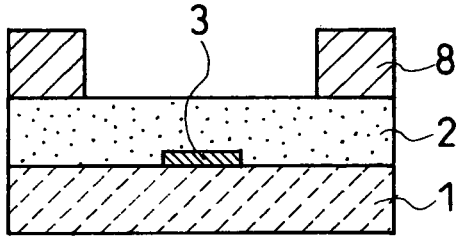
Figure 12F:
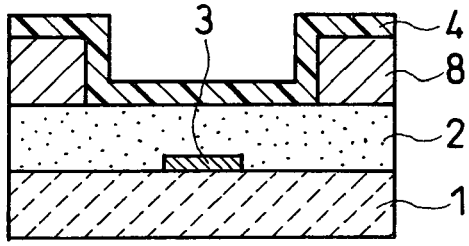
Figure 12G:
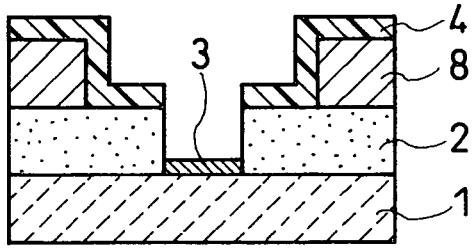

FIG. 11 is a cross-sectional view of the electron emission device according to the second embodiment of the invention, in which constituent components or parts similar to those shown in FIG. 8 are designated by similar numerals.

The electron emission device according to this embodiment is a cold-cathode field emission-type electron source comprising a laminated structure including a substrate, a gate insulating film and a gate metal, as in the first embodiment. A hole (opening) is provided in the gate metal and the gate insulating film, and an emitter is provided at the bottom layer of the hole.

In FIG. 11, numeral 1 designates a substrate, 2 a first layer of a gate insulating film having a film thickness T01, 8 a second layer of the gate insulating film having a film thickness T02, 3 an electron emission portion (emitter), 4 a gate electrode having an opening width Wh and a film thickness Tg1 and made of Cu, 6 an emitted electron (electron trajectory), 7 an equipotential surface, and 11 an anode electrode.

As the first layer 2 and the second layer 8 of the gate insulating film have different opening widths Wh and Wg (wherein Wh<Wg), the gate electrode 4 has a stepped structure, constituting a control electrode and a focusing electrode.

In the present embodiment, the first and the second layers of the gate electrode are formed by the two kinds of insulating films 2 and 8, thereby providing the step, so that the electric field strength near the electron emission control unit is varied between the center portion and the peripheral portion of each pixel (or each sub-pixel). When the thickness T01 of the first layer 2 of the gate insulating film is 3 μm, the thickness T02 of the second layer 8 of the gate insulating film is 3 μm, the film thickness Tg1 of the gate electrode 4 is 5000 Å, the opening width Wh of the first layer 2 of the gate insulating film is 3 μm, the opening width Wg of the second layer 8 of the gate insulating film is 9 μm, the emitter-anode distance is 1 mm, the gate ON voltage is 3 V, and the anode voltage is 5000 V, the spot size of the electron beam would be 9.73 μm, which is 28.8% smaller than the spot size 13.67 μm of the electron beam when the second layer 8 of the gate insulating film is absent.

Two kinds of material are used in the insulating film for the following reasons. By providing different properties in the first and the second insulating films, surface creepage between the gate electrode and the emitter (which is a discharge that occurs along a solid surface (boundary surface) of an insulator when the solid surface exists between discharge electrodes placed in a gas or vacuum), or abnormal discharge caused by the generation of gas due to temperature rise around the emitter can be prevented. This way, the electron emission stability and the anti-emitter destruction property can be enhanced, and further the step in the insulating film can be accurately formed.

In the first layer of the insulting film, a material with a small relative permittivity must be employed. By using a material with a small relative permittivity, the electric field strength can be reduced at a portion called a triple contact where the electrode, the dielectric, and vacuum meet and from which a surface creepage could start. Therefore, the generation of surface creepage can be prevented. Examples of such a material include silica materials such as SOG, and SiOx.

The second layer of the insulating film must employ a material that can be easily (and thickly) coated on a large area and that, in order to control its thermal distribution, has good thermal conduction. Examples of such a material include alumina sol. Compared to SOG, for example, alumina sol can be formed into a thick film by a single coating operation, so that the manufacturing process can be shortened and a better thermal conduction can be obtained than when using a silica material that is used in the first layer of the insulating film.

Hereafter, an example of the method of manufacturing the electron emission device according to the second embodiment will be described.

FIG. 12 shows cross-sectional views illustrating the process of manufacturing the electron emission device according to the second embodiment. FIG. 12 shows the manufacturing process schematically, and a manufacturing system for the process may be constructed appropriately by taking productivity or the like into consideration.

FIG. 12(*a*) shows the deposition of Al as the material for the emitter electrode on a substrate 1 by a CVD method. The emitter electrode is then patterned by photolithography, as shown in FIG. 12(*b*).

Then, a gate insulating film 2 is formed to a thickness of 3 μm using SOG, as shown in FIG. 12(*c*).

Then, a second gate insulating layer 8 is formed to a thickness of 3 μm using alumina sol, as shown in FIG. 12(*d*).

Then, the second gate insulating layer 8 is etched using a phosphoric acid-based etchant to open a hole with a width 10 μm, thereby providing the gate insulating film with a step, as shown in FIG. 12(*e*).

Then, a gate electrode 4 with a thickness 5000 Å with a stepped structure is formed by vapor deposition or sputtering using Cu, as shown in FIG. 12(*f*).

Then, the gate electrode at the center of the bottom of the gate electrode step is etched to form an opening with a width of 3 μm, and then the first layer 2 of the gate insulating film is etched using buffered hydrofluoric acid until the emitter 3 is revealed, as shown in FIG. 12(*g*). The electron emission device is completed by the steps so far described.

Instead of Cu, any metal may be used in the gate electrode as long as its electrical resistance is sufficiently low. The method of forming the gate electrode may also employ electrolytic plating or MOCVD, instead of vapor deposition or sputtering.

As described above, in the electron emission device according to the second embodiment, two kinds of insulator are used in the gate insulating film to provide the gate electrode 4 with a stepped structure, so that the electric field strength near the electron emission control unit is varied between the central portion and the peripheral portion of each pixel. Accordingly, the second embodiment can control the spread of the electron beam as in the first embodiment, so that a device employing a field emission-type electron source array capable of achieving a high emission current density with low voltage can be realized at low cost.

Third Embodiment

Figure 13:
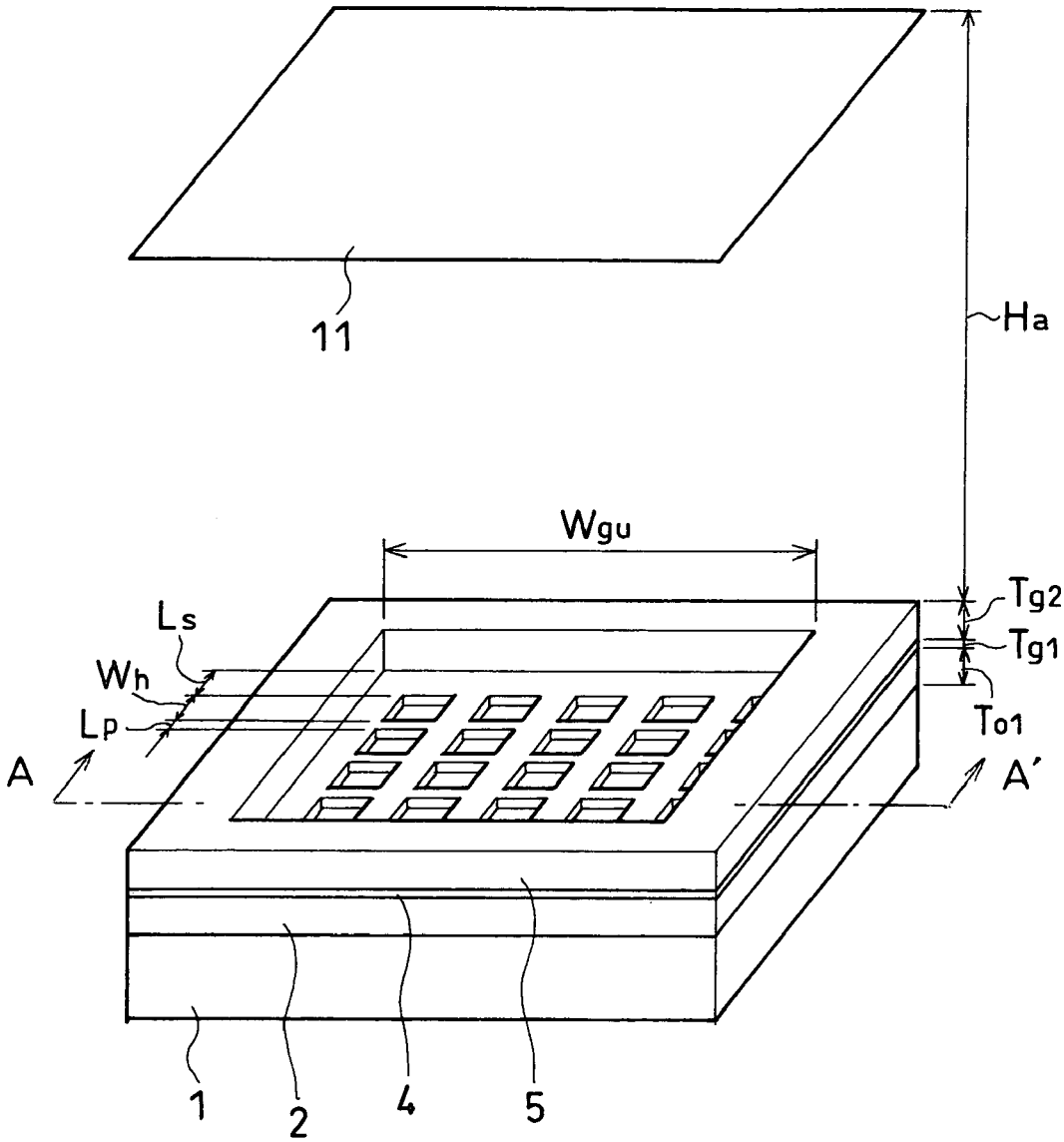
FIG. 13 shows a perspective view of the electron emission device according to a third embodiment of the invention.
Figure 14:
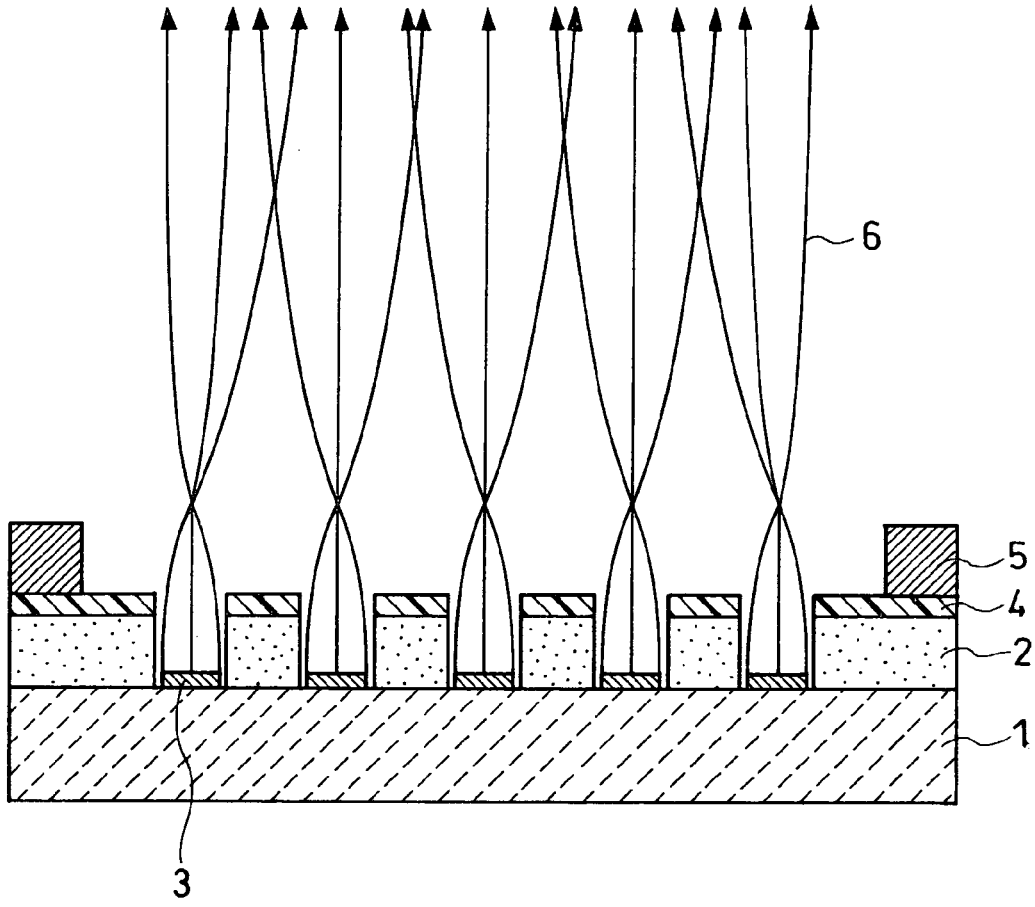
FIG. 14 is a cross sectional view taken along line A–A' of FIG. 13.

FIG. 13 shows a perspective view of the electron emission device according to a third embodiment of the invention. FIG. 14 is a cross sectional view along line A–A' of FIG. 13. Constituent elements or parts similar to those of FIG. 8 are designated by similar numerals or signs.

As in the first embodiment, the electron emission device according to the present embodiment is a cold-cathode field emission-type electron source having a laminated structure made up of a substrate, a gate insulating film, and a gate metal. A hole (opening) is formed in the gate metal and the gate insulating film. A plurality of emitters are provided at a bottom layer of the hole for each pixel.

In FIGS. 13 and 14, numeral 1 designates a substrate, 2 a gate insulating film, 3 a plurality of field emitting portions (emitters), 4 a first layer of the gate electrode having an opening width Wh for each emitter and a film thickness Tg1 and being made of Cu (a first metal), 5 a second layer of the gate electrode having an opening width Wgu for a plurality of emitters for each pixel and a film thickness Tg2 (wherein Wh<<Wgu, Tg1<<Tg2) and being made of Al (a second metal), 6 an emitted electron (electron trajectory), and 11 an anode electrode.

The gate electrode surrounding the outer-most emitters has a stepped structure formed by the first layer 4 and the second layer 5 of the gate electrode, as in the first embodiment.

As shown in FIG. 13, when the plurality of emitters are activated all at once, the gate electrode is provided with a step such that the outer-most emitters are surrounded by the gate electrode. The height of the step should preferably be increased when the number of emitters per pixel is large and therefore Wgu is large, and it should be decreased when the number of emitters is small and Wgu is therefore small. For example, when the film thickness To1 of the gate insulating film is 3 μm, the film thickness Tg1 of the first layer of the gate electrode is 5000 Å, and the opening width Wh of the fist layer 4 of the gate electrode is 3 μm, a distance Ls between the periphery of the emitters and the gate step is 3 μm, an emitter interval Lp is 3 μm, an emitter-anode distance Ha is 1 mm, a gate ON voltage is 3 V, an anode voltage is 5000 V, the number of emitters inside the step of the gate is 5×5, and the film thickness Tg2 of the second layer 5 of the gate electrode is 0.75 μm, the spot of the electron beam would expand beyond the gate step by 5.1 μm. However, when Tg2 is 1.5 μm, the spread of the spot of the electron beam can be contained to be within 2.9 μm of the gate step. In a similar structure, when the number of emitters inside the gate step is 3×3, the spot of the electron beam would expand beyond the gate step by 6.7 μm if Tg2 is set to be 1.5. However, by setting Tg2 to be 0.75 μm, the spread of the electron beam spot can be contained within 5.1 μm of the gate step. When the thickness Tg2 of the second layer of the gate electrode is 0, the spot would expand beyond the periphery of the emitters by 11.5 μm.

Figure 15:
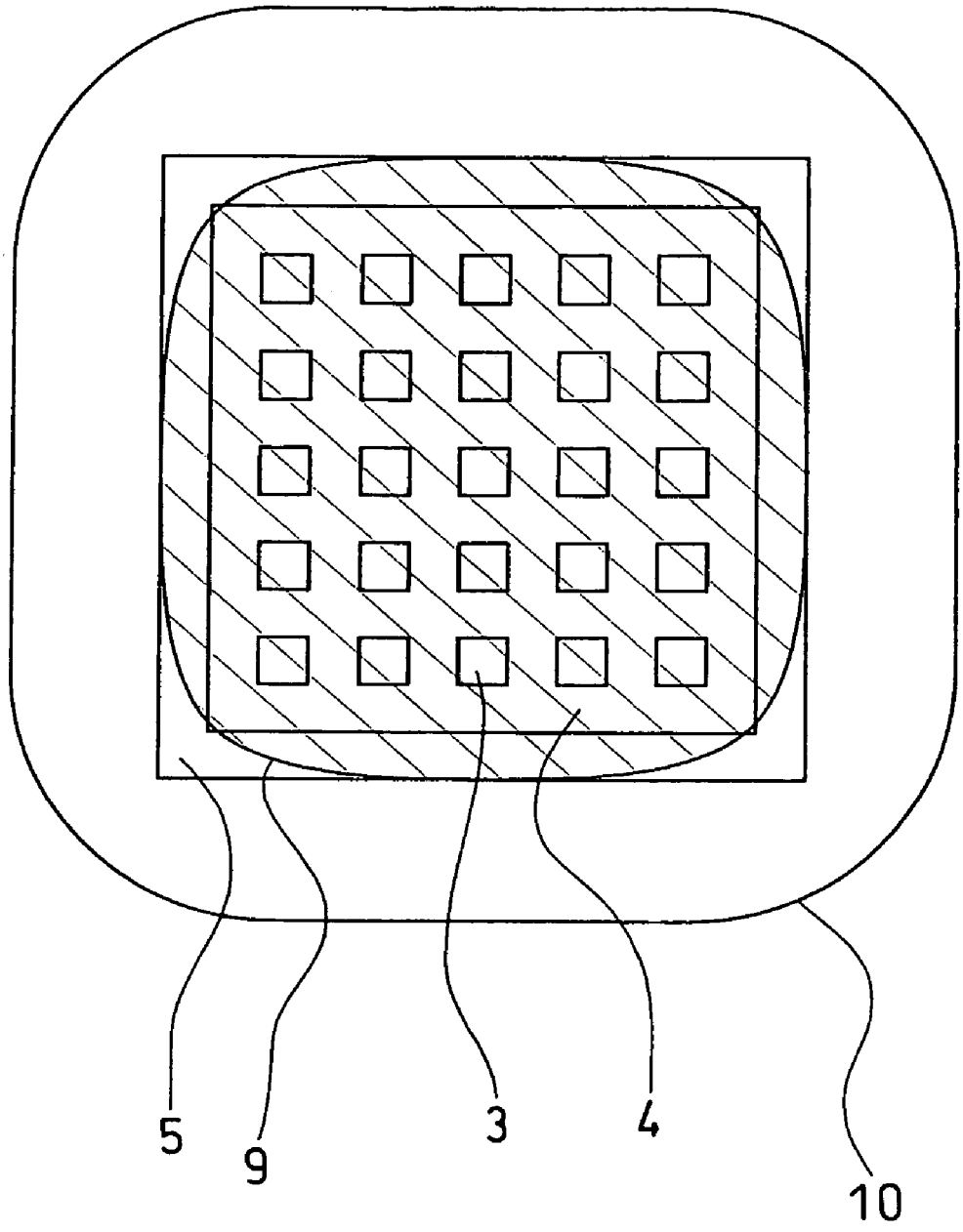
FIG. 15 shows the electron beam spot in the case where the number of emitters surrounded by the gate step in the electron emission device according to the present embodiment is large (5×5).
Figure 16:
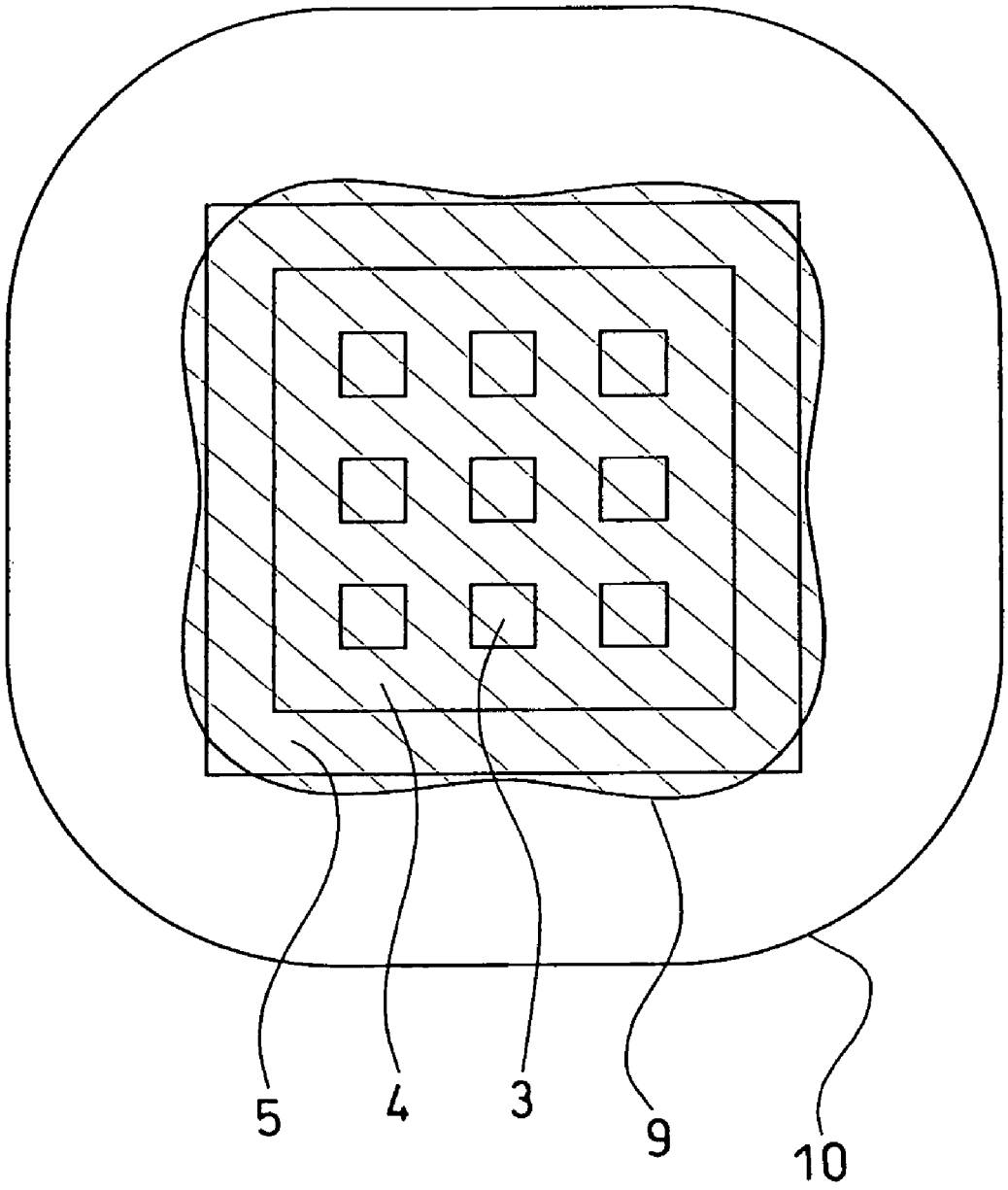
FIG. 16 shows the electron beam spot in the case where the number of emitters surrounded by the gate step in the electron emission device according to the present embodiment is small (3×3).

FIG. 15 shows the electron beam spot when the number of emitters surrounded by the gate step is large (5×5) in the electron emission device according to the present embodiment. FIG. 16 shows the electron beam spot when the number of emitters surrounded by the gate step is small (3×3).

In these figures, numeral 9 designates the spot (indicated by hatching) of the electron beam in the presence of the gate step according to the present embodiment. Numeral 10 designates the spot of the electron beam according to the prior art where the gate step is absent.

Thus, FIG. 15 shows the difference in electron beam spots due to the presence of the gate step in the case where the number of emitters inside the gate step is 5×5, as in the electron emission device shown in FIGS. 13 and 14. FIG. 16 shows the difference in the electron beam spots due to the presence of the gate step in the case where the number of emitters inside the gate step is 3×3.

It will be seen from these figures that the spread of the electron beam can be controlled by the step provided in the gate.

It will also be seen that, while the electron beam spot spreads partly beyond the pixels at the four edges when the number of emitters is 3×3, this can be improved by making the number of emitters 5×5.

Thus, the electron emission device according to the third embodiment includes a plurality of emitters per pixel, in which a step is provided to the gate electrode such that the step surrounds the outer-most emitters. In this way, the electric field strength near the electron emission control unit can be varied between the central portion and the peripheral portion of each pixel, so that the spread of the electron beam can be controlled.

In the electron emission device according to the present embodiment two kinds of metal are used to provide the step in the gate electrode such that the step surrounds the outer-most emitters. However, this is only exemplary and any other configuration may be used as long as it is capable of providing different electric field strengths near the electron emission control unit between the central portion and the peripheral portion of each pixel. For example, the step may be provided to the gate electrode 4 by using two kinds of insulators such that the step surrounds the outer-most emitters, as in the second embodiment.

Fourth Embodiment

Figure 17:
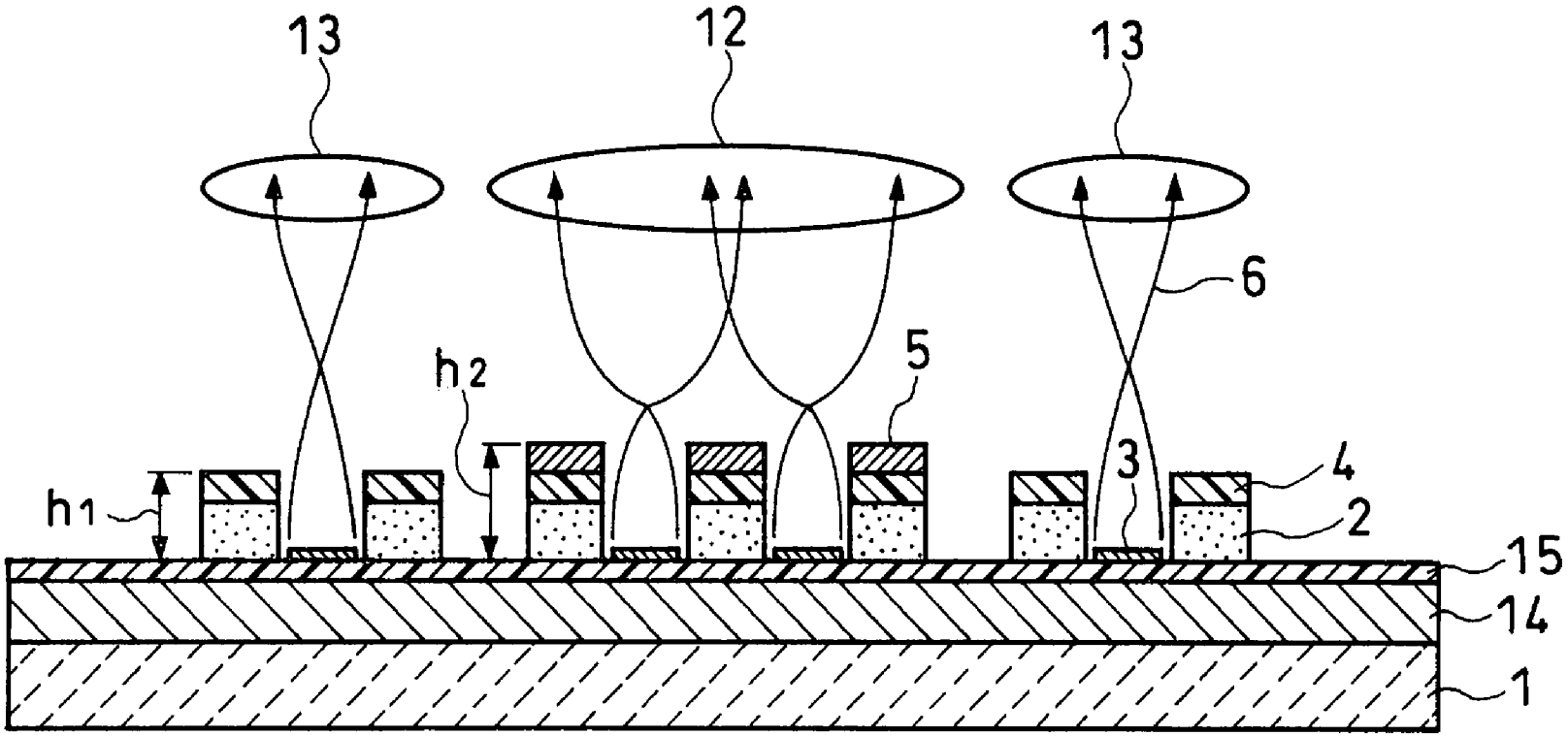
FIG. 17 is a cross sectional view of the electron emission device according to a fourth embodiment of the invention.
Figure 18:
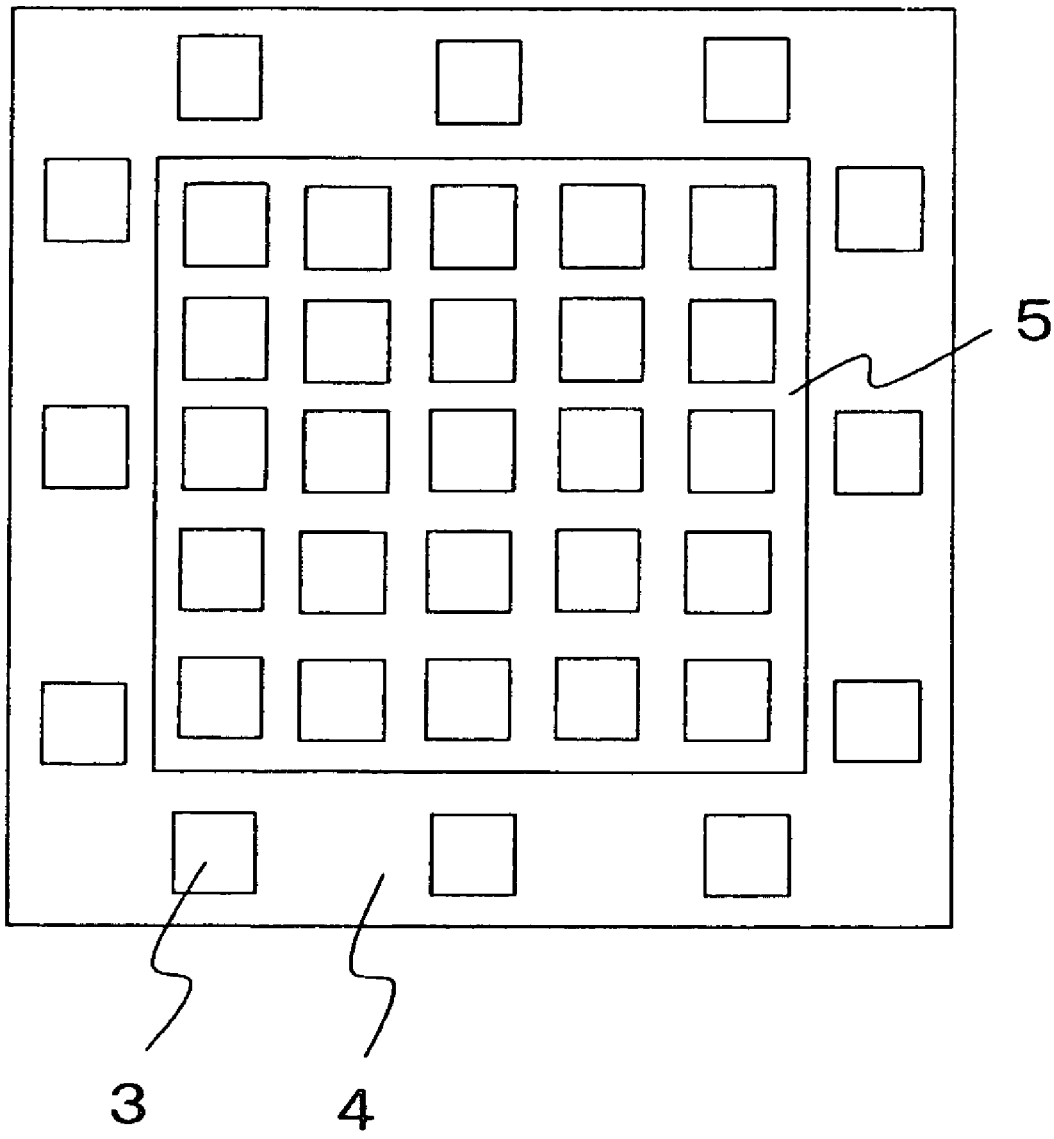
FIG. 18 is a top plan view of the electron emission device according to the present embodiment.

FIG. 17 is a cross sectional view of the electron emission device according to a fourth embodiment of the invention. FIG. 18 is a top plan view of the electron emission device. Constituent elements similar to those shown in FIGS. 8 and 14 are designated by similar numerals.

The electron emission device according to the present embodiment, as in the first and the third embodiments, is a cold-cathode field emission-type electron source comprising a laminated structure made up of a substrate, a gate insulating film, and a gate metal. The gate metal and the gate insulating film have a hole (opening), and a plurality of emitters are provided at the bottom layer of the hole for each pixel.

In FIGS. 17 and 18, numeral 1 designates a substrate, 14 a cathode wiring, 15 a ballast resister layer, 2 a gate insulating film, 3 a plurality of field emitting portions (emitters), 4 a first layer of the gate electrode made of Cu, 5 a second layer of the gate electrode made of Al and formed only at the central portion of the pixel, 6 an emitted electron (electron trajectory), 12 an electron beam at the central portion of the pixel, and 13 an electron beam at the peripheral portion of the pixel.

In the present embodiment, as shown in FIG. 17, the second layer 5 of the gate electrode is formed by masking so that the second layer 5 is formed only at the central portion of the pixel (h2>h1). The height of the first layer 4 of the gate electrode in the peripheral portion of the pixel is designated as h1, and the height of the second layer 5 of the gate electrode at the pixel central portion is h2 (wherein h2>h1).

The value of gate opening/gate height is smaller in the pixel central portion (region with h2) than in the pixel peripheral portion (region with h1). Thus, the effect of controlling the amount of electrons emitted from each emitter can be enhanced, as will be seen by comparing the electron beam 12 at the pixel central portion and the electron beam 13 at the pixel peripheral portion in FIG. 17, with the electron beam in FIG. 6.

In this case, while in the pixel central portion (region with h2) the electron beam spot on the anode surface is expanded, no problem arises as far as display is concerned because only the electron beam that expands beyond the pixel region is problematic.

While the effect of controlling the amount of electrons emitted from each emitter at the pixel peripheral portion (region with h1) is less than that at the central portion, the electron beam spot can be made smaller.

Thus, the spread of the emitted electron beam as a whole beyond the pixel region can be prevented.

Further, as the above-described configuration provides different electric field strengths and therefore the amounts of electron emission are also different. However, in the present embodiment, the intra-plane electron emission characteristics can be made uniform between the pixel peripheral portion and the central portion that have different electric field strength by inserting a ballast resister layer 15 and making the intra-plane distribution of the gate openings at the pixel peripheral portion less dense than at the pixel central portion, as shown in FIG. 18.

In this way, the electron beams from the individual emitters can be superposed, so that the effect of controlling the electron emission amount at the pixel central portion where the current density is increased can be enhanced. As a result, the black floating on the display device can be prevented.

As described above, the electron emission device according to the fourth embodiment comprises a plurality of emitters per pixel, in which the height h2 of the first layer 4 and the second layer 5 of the gate electrode at the pixel central portion is set to be larger than the height h1 of the first layer 4 of the gate electrode at the pixel peripheral portion (h2>h1). Thus, the electric field strength near the electron emission control unit can be varied between the central portion and the peripheral portion in each pixel, so that the spread of the electron beam can be controlled.

Fifth Embodiment

Figure 19:
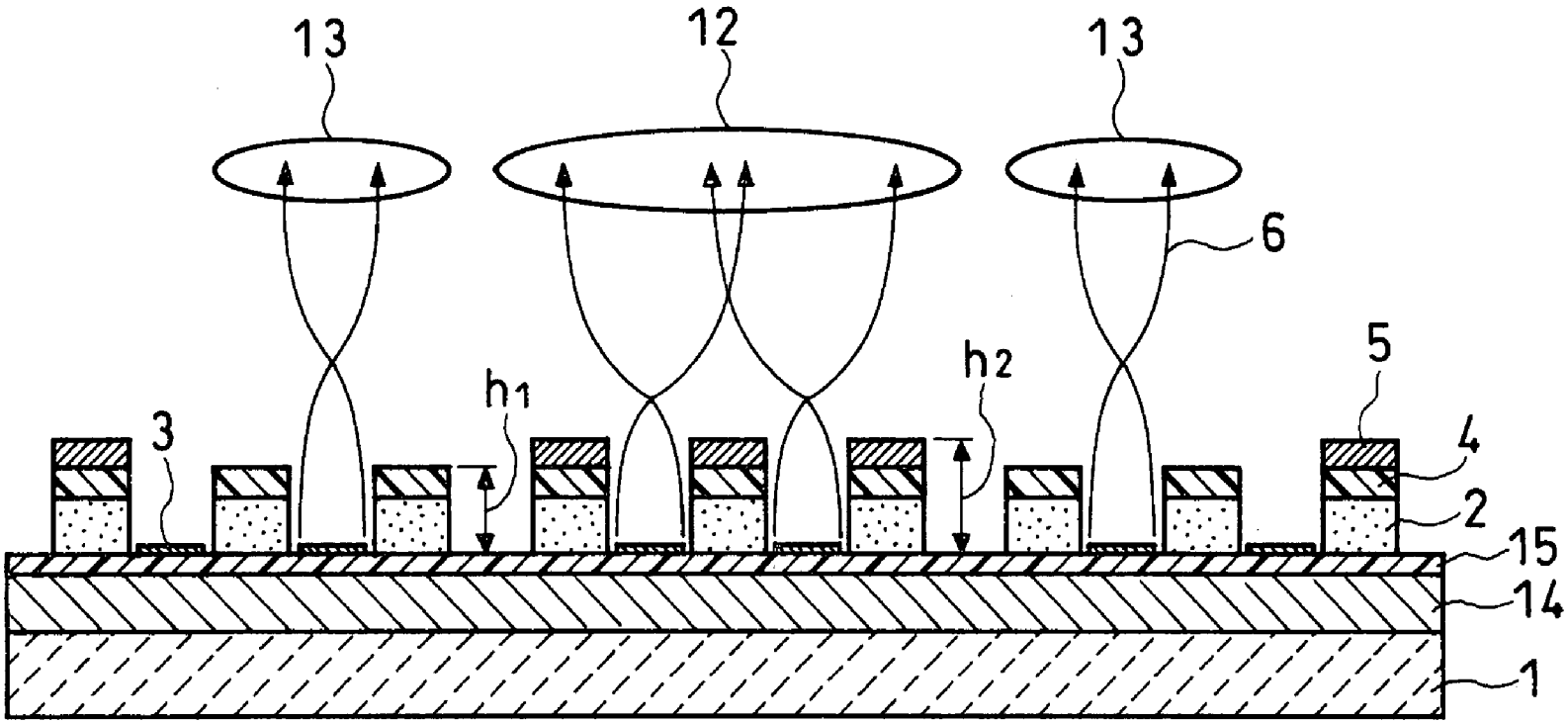
FIG. 19 is a cross sectional view of the electron emission device according to a fifth embodiment of the invention.

FIG. 19 is a cross sectional view of the electron emission device according to the fifth embodiment of the invention. Elements similar to those shown in FIG. 17 are designated by similar numerals.

In the fourth embodiment, the second layer 5 of the gate electrode is formed only at the pixel central portion. In the present embodiment, however, as shown in FIG. 19, the second layer of the gate electrode is formed at the periphery portion and the central portion of the pixel to a gate electrode height h2 by masking. A region of a gate height h1 (h2>h1) made up only of a first layer of the gate electrode is formed between the two portions.

Thus, as compared with the fourth embodiment, a downwardly protruding equipotential surface is formed as seen from the pixel as a whole, the pixel as a whole can be provided with a focusing effect, so that the spread of the electron beam can be better improved.

Sixth Embodiment

In the fourth and the fifth embodiments, the second layer 5 of the gate electrode is formed at the central portion or the peripheral portion of the pixel to the gate electrode height h2, so that the electric field strength near the electron emission control unit is varied between the central and the peripheral portions of each pixel. In the sixth embodiment, a plurality of emitters are formed such that the potential can be independently controlled for the individual emitters, thus eliminating the need to form the second layer of the gate electrode.

Figure 20:
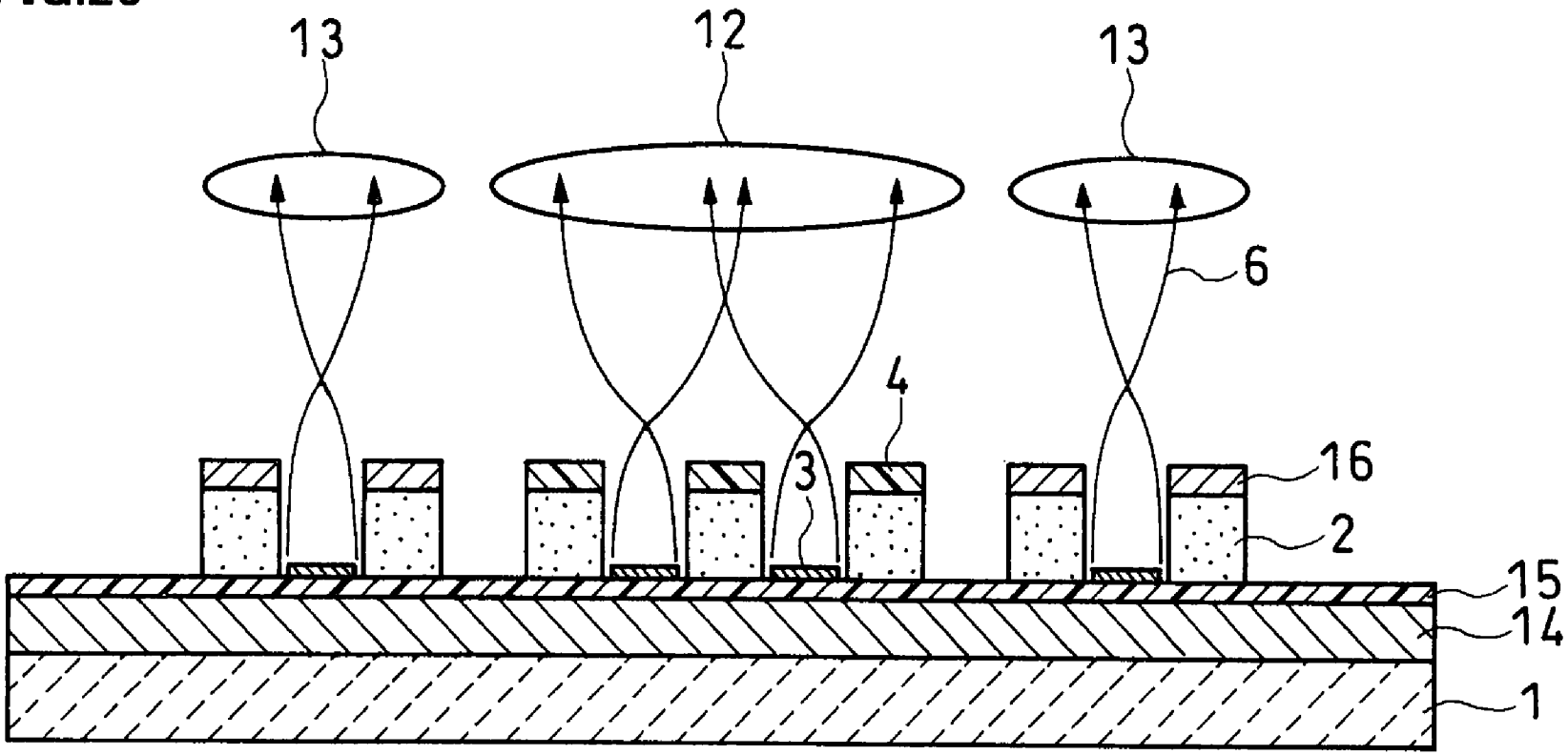
FIG. 20 is a cross sectional view of the electron emission device according to a sixth embodiment of the invention.
Figure 21:
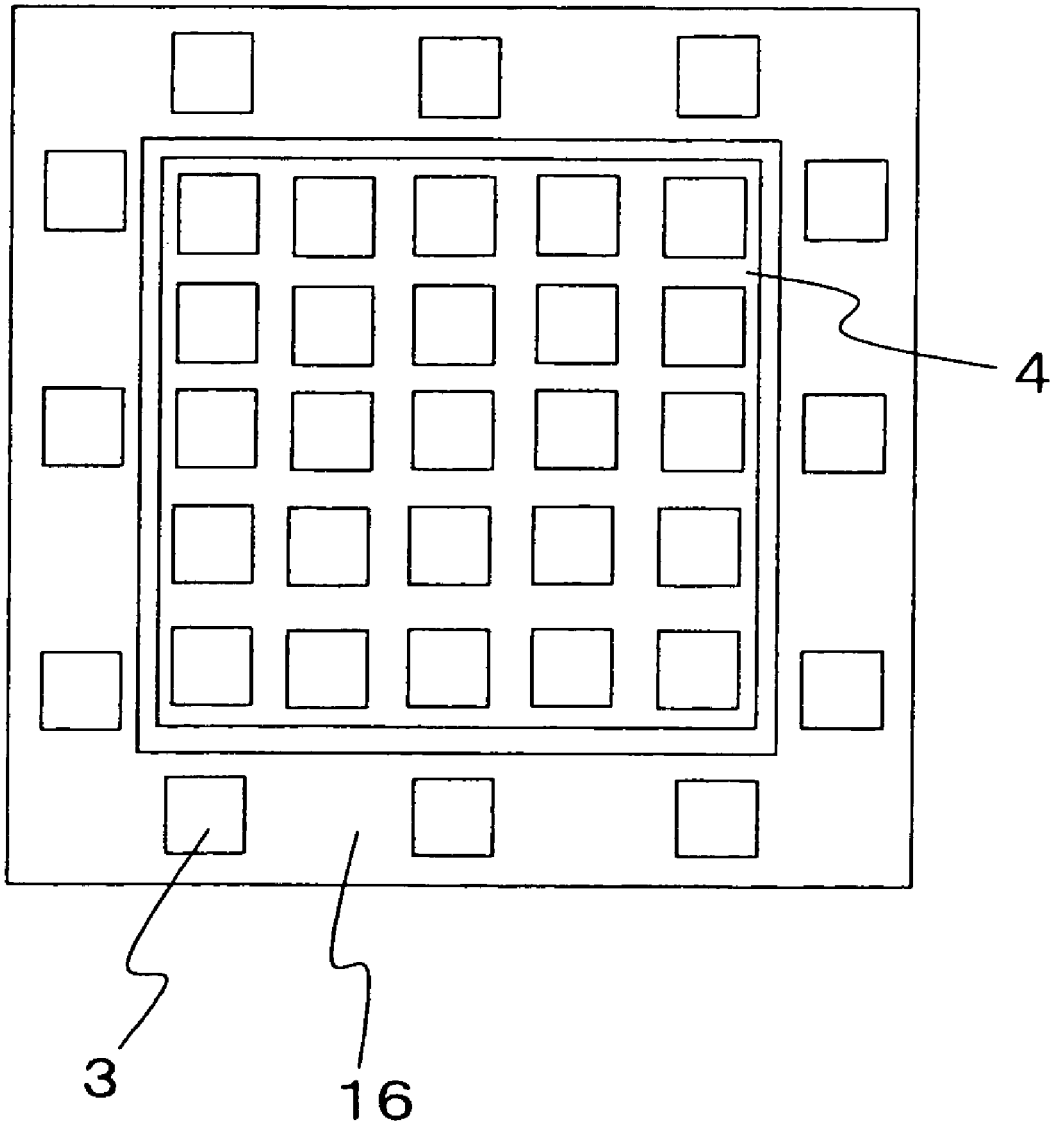
FIG. 21 is a top plan view of the electron emission device according to the present embodiment of the invention.

FIG. 20 is a cross sectional view of the electron emission device according to the sixth embodiment of the invention. FIG. 21 is a top plan view of the electron emission device. Constituent elements similar to those shown in FIGS. 17 and 18 are designated by similar numerals.

In FIGS. 20 and 21, numeral 1 designates a substrate, 14 a cathode wiring, 15 a ballast resistor layer, 2 a gate insulating film, 3 a plurality of field emitting portions (emitters), 4 a first layer of the gate electrode formed at the pixel central portion, 16 a first layer of the gate electrode formed at the pixel peripheral portion, 6 an emitted electron (electron trajectory), 12 an electron beam at the pixel central portion, and 13 an electron beam at the pixel peripheral portion.

As shown in FIG. 20, when the first layer of the gate electrode is formed, the gate electrode is electrically separated within the pixel. The potential of the first layer 4 of the gate electrode at the pixel central portion is maintained at Vg1, while the potential Vg2 of the first layer 16 of the gate electrode at the pixel peripheral portion is set to be higher than Vg1 (Vg2>Vg1).

Thus, the potential of the gate electrode is set such that the potential difference between the emitter 3 and the gate electrode varies to be large and then small concentrically from the peripheral portion toward the central portion within each pixel.

The gate potential for the electron beam 12 at the pixel central portion (region with Vg1) is lower than that of the electron beam 13 at the pixel peripheral portion (region with Vg2), so that the effect of controlling the amount of electrons emitted from the individual emitters can be enhanced.

In this case, at the pixel central portion, the electron beam spot on the anode surface spreads, but this does not result in any problems for display purposes, as only the electron beam that spreads beyond the pixel region is problematic.

On the other hand, in the pixel peripheral portion, the effect of controlling the amount of electrons emitted by the individual emitters is less than that at the central portion, the electron beam spot can be reduced in size.

Thus, the spread of the emitted electron beam as a whole beyond the pixel region can be prevented.

The different electric field strengths result in different amounts of electron emission. In the present embodiment, as in the fourth embodiment, the intra-plane electron emission characteristics at the periphery and the central portions of the pixel with different electric field strengths can be made uniform by inserting the ballast resistor layer 15 and by making the distribution of the gate openings at the pixel periphery portion less dense than at the pixel central portion, as shown in FIG. 21.

Thus, the effect of controlling the amount of electrons emitted at the pixel central portion, where the current density is high, can be enhanced by the superposition of the electron beam from the individual emitters, so that the problem of the black floating on the display apparatus can be prevented.

Seventh Embodiment

In the sixth embodiment the potential of the gate electrode is set such that the potential difference between the emitter 3 and the gate electrode varies to be large and then small concentrically from the periphery portion toward the central portion of each pixel. In the seventh embodiment, the potential of the gate electrode is set such that the potential difference between the emitter 3 and the gate electrode varies to be small, large, and then small again from the periphery portion toward the central portion of each pixel concentrically.

Figure 22:
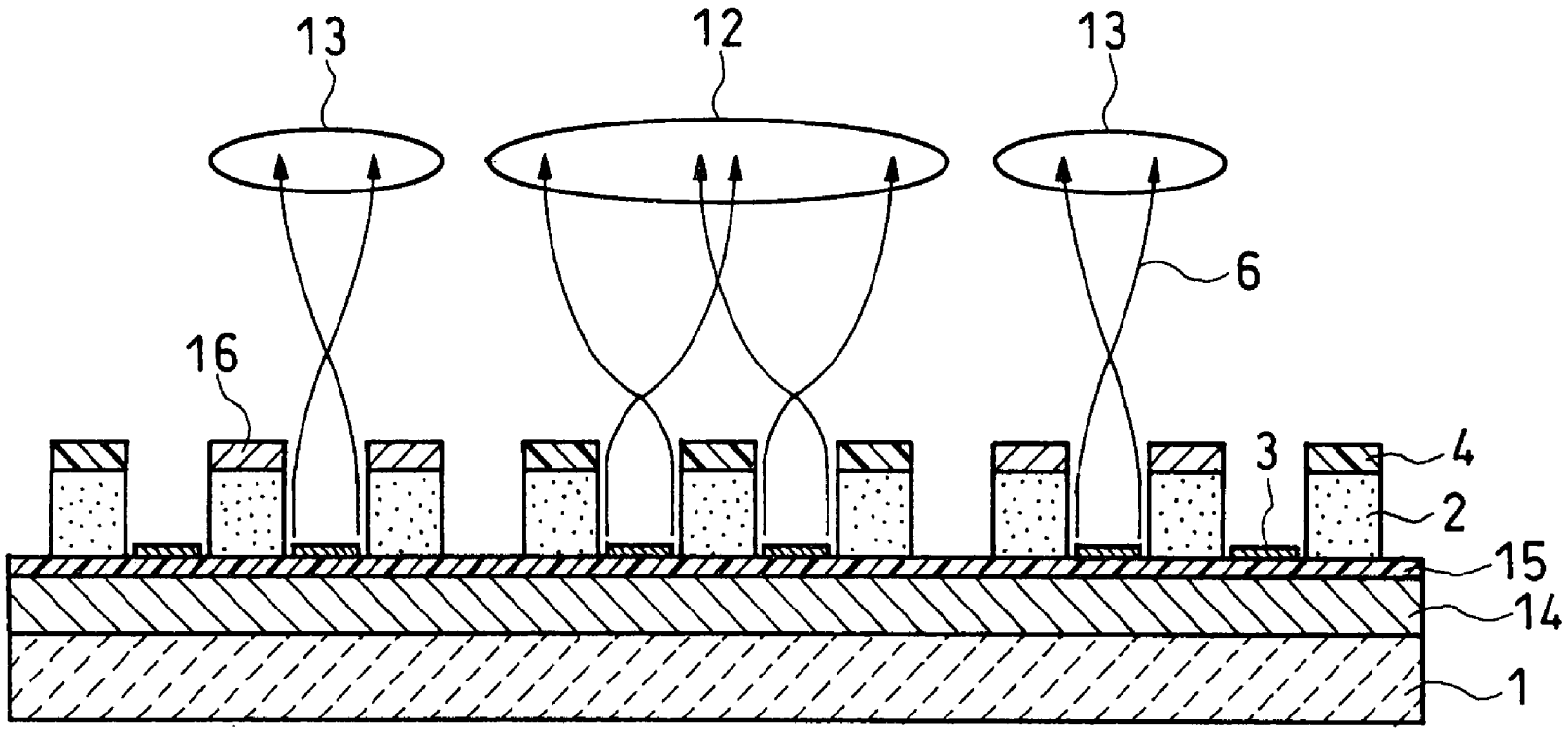
FIG. 22 is a cross sectional view of the electron emission device according to a seventh embodiment of the invention.

FIG. 22 is a cross sectional view of the electron emission device according to the seventh embodiment of the invention. Constituent elements similar to these shown in FIG. 20 are designated by similar numerals.

In FIG. 22, numeral 1 designates a substrate, 14 a cathode wiring, 15 a ballast resistor layer, 2 a gate insulating film, 3 a plurality of field emitting portions (emitters), 4 a first layer of the gate electrode formed at the pixel central portion, 16 a first layer of the gate electrode formed at the pixel peripheral portion, 6 an emitted electron (electron trajectory), 12 an electron beam a the pixel central portion, and 13 an electron beam at the pixel peripheral portion.

As shown in FIG. 22, when the first layer of the gate electrode is formed, the gate electrode is electrically separated within the pixel. The potentials of the first layer 4 of the gate electrode at the peripheral portion and the central portion of the pixel are maintained at the same potential Vg1. The potential Vg2 at the first layer 16 of the gate electrode between the two portions is set to be higher than Vg1 (Vg2>Vg1).

Thus, as compared with the sixth embodiment, a downwardly protruding equipotential surface is formed for the pixel as a whole, so that the pixel as a whole can be provided with a focusing effect. Thus, the spread of the electron beam can be better controlled.

In the electron emission device according to the present embodiment, the potential of the first layer of the gate electrode at the periphery and the central portions of the pixel is maintained at the same potential Vg1, while the potential Vg2 of the first layer 16 of the gate electrode between these two portions is set to be higher (Vg2>Vg1). However, this is only exemplary and the potential of the first layer 4 of the gate electrode may be different between the periphery and the central portions of the pixel, as long as the potential difference between the emitter 3 and the gate electrode varies to be small, large, and then small again concentrically from the periphery portion toward the central portion of each pixel.

Further, any configuration may be used as long as the electric field strength near the electron emission control unit varies between the central portion and the peripheral portions of each pixel or sub-pixel. For example, the various distances between the gate electrode and the emitter in the first to fifth embodiments may be used in combination with the various magnitudes of the potential difference between the electron emitting portion and the gate electrode, with the distance between the gate electrode and the emitter maintained at a constant value, in the sixth and the seventh embodiments.

All publications, patents and patent applications cited herein are incorporated hereby by reference in their entirety.

Industrial Applicability

As described above, in accordance with the invention, the electric field strength near the electron emission control unit is varied between the central portion and the peripheral portion of each pixel, that the spread of the electron beam can be controlled.

With Ea≧Eg, the gate electrode is made to function as a focusing electrode, so that the need to provide a separate focusing electrode can be eliminated and the manufacturing process can be simplified. At the same time, the amount of gate current that results in loss can be reduced, and the spread of the electron beam can be controlled regardless of the ratio between Ea and Eg.

At the same time, in the gate opening, an upwardly protruding equipotential surface that does not extend beyond a first plane toward the anode is formed, and a downwardly protruding equipotential surface is formed between the first and a second plane. As a result, the electron beam that has once spread slightly can be focused, so that the point of focus (crossover point) of the focused electron beam can be shifted toward the anode. Thus, the spread of the electron beam beyond the crossover point can be controlled.

Further, by making the ratio of gate opening width to gate height equal to or smaller than 5/3, the amount of electron emission can be sufficiently controlled.

By providing separate and a plurality of electron emission control units within each pixel, the influence of the spread of the electron beam is due only to the electrons emitted toward the outside of the pixel via the gate opening portions formed at the periphery portion. Further, the gate-emitter distance can be reduced while maintaining the ratio between the gate opening and the gate-emitter distance. Accordingly, the spread of the electron beam can be better controlled and, at the same time, the drive voltage can be reduced while maintaining the effect of controlling the amount of electrons emitted.

By varying the potential difference between the electron emitting portion and the gate electrode to be large and then small concentrically from the periphery portion toward the central portion of the pixel, while maintaining the distance between the separate gate electrodes and electron emitting portions constant, the spread of the electron beam can be controlled. At the same time, the effect of controlling the amount of electrons emitted at the pixel central portion, where the current density is high, can be enhanced during the control of the amount of electrons emitted, and the black floating on the display apparatus can be prevented.

By varying the potential difference between the electron emitting portion and the gate electrode to be small, large, and then small again concentrically from the peripheral portion toward the central portion of the pixel, while maintaining the distance between the separate gate electrodes and electron emitting portions constant, the spread of the electron beam can be better controlled. At the same time, the effect of controlling the amount of electrons emitted at the pixel central portion, where the current density is high, can be enhanced during the control of the electron emission amount, so that the black floating can be prevented.

Further, by varying the distance between the separate gate electrodes and electron emitting portions to be short and then large from the peripheral portion toward the central portion of the pixel concentrically, the spread of the electron beam can be better controlled. At the same time, the effect of controlling the amount of electrons emitted at the pixel central portion, where the current density is high, can be enhanced during the control of the electron emission amount, so that the black floating on the display apparatus can be prevented.

Further, by varying the distance between the separate gate electrodes and electron emitting portions to be long, short, and then long again from the peripheral portion toward the central portion of the pixel concentrically, the spread of the electron beam can be controlled. At the same time, the effect of controlling the amount of electrons emitted at the pixel central portion, where the current density is high, can be enhanced during the control of the amount of electron emission, so that the black floating on the display apparatus can be prevented.

Further, by providing the distribution of a plurality of electron emitting portions in the pixel with an intra-plane distribution, the electron beam within the pixel can be made uniform and, at the same time, the probability of dielectric breakdown between the emitter and the gate can be reduced.

Further, by forming a ballast resistor layer, the variation of the amount of electron emission due to differences in the electric field strengths can be controlled, so that the uniformity of the electron beam within the pixel can be further improved.

By using a material that emits electrons at a electric field strength of not more than 10 V/μm for the emitter, dielectric breakdown due to discharge or the like can be prevented.

Further, by making the emitter planar in shape and preventing the concentration of electron emission at a specific region, the emitter can be made less likely to break. Further, as the electron emission region is large, much current can be obtained.

By using a material that emits electrons at low electric fields, such as carbon nanotube, the anode-gate electric field strength can be made stronger than the strength of the gate-emitter electric field necessary for electron emission, so that the drive method according to the invention can be realized.

Further, the simple structure according to the invention in which a cold cathode is used and a focusing electrode is not used, the spread of the electrons can be prevented and no crosstalk occurs. Thus, a field emission display can be realized capable of bombarding electrons onto a phosphor efficiently.

What is claimed is:

1. An electron emission device comprising:

a gate electrode formed on a substrate via an insulating film;

an emitter formed in a gate opening provided through said insulating film and said gate electrode; and an anode electrode disposed away from said emitter with a predetermined distance, wherein said gate electrode comprises at least two kinds of gate electrodes including a first gate electrode made of a first material and a second gate electrode formed closer to said anode electrode than said first gate electrode and made of a second material, and wherein the lateral cross-sectional area of the opening of said second gate electrode is larger than that of the opening of said first gate electrode continuously or discontinuously, and when a potential difference is provided between the gate electrode and the emitter, an upwardly protruding equipotential line in the direction from the emitter toward the anode electrode, and a downwardly protruding equipotential line protruding away from the anode electrode, are both formed near the first gate opening region.

2. The electron emission device according to claim 1, wherein said plurality of emitters have an intra-plane distribution within a pixel.

3. A field emission display comprising said electron emission device according to claim 1, wherein said electron emission device is formed in a two-dimensional matrix.

4. An electron emission device comprising:

a gate electrode formed on a substrate via an insulating film;

an emitter formed in a gate opening provided through said insulating film and said gate electrode; and an anode electrode disposed away from said emitter with a predetermined distance, wherein said insulating film comprises at least two kinds of insulating films including a first insulating film made of a first material and a second insulating film formed closer to said anode electrode than said first gate electrode and made of a second material, and wherein the lateral cross-sectional area of the opening of said second insulating film is larger than that of the opening of said first insulating film continuously or discontinuously, and wherein said gate electrode is formed at the opening of said first insulating film and the opening of said second insulating film continuously.

5. An electron emission device comprising:

a gate electrode formed on a substrate via an insulating film;

an emitter formed in a gate opening provided through said insulating film and said gate electrode; and an anode electrode disposed away from said emitter with a predetermined distance, wherein said gate electrode comprises a first gate electrode region having a first opening diameter and a second gate electrode region having a second opening diameter, wherein said second opening diameter is larger than said first opening diameter continuously or discontinuously, and wherein when a potential difference is provided between said gate electrode and said emitter, an upwardly protruding equipotential surface in the direction from said emitter to said anode electrode, and a downwardly protruding equipotential surface are formed near said first gate opening region.

6. An electron emission device comprising:

a gate electrode formed on a substrate via an insulating film;

at least one emitter formed in a gate opening provided through said insulating film and said gate electrode; and an anode electrode disposed away from said emitter with a predetermined distance, wherein said gate electrode has such a structure that it projects toward said anode electrode at an outer-most peripheral portion surrounding said emitter, and when a potential difference is provided between the gate electrode and the emitter, an upwardly protruding equipotential line in the direction from the emitter toward the anode electrode, and a downwardly protruding equipotential line protruding away from the anode electrode, are both formed near the gate opening.

7. An electron emission device comprising:

a gate electrode formed on a substrate via an insulating film;

a gate opening provided through said insulating film and said gate electrode;

an emitter formed in said gate opening; and an anode electrode disposed away from said emitter by a predetermined distance, wherein said gate electrode comprises a first gate electrode region surrounding said gate opening and said emitter and having a first height, and a second gate electrode region surrounding said first gate electrode region and having a second height higher than said first height, and when a potential difference is provided between the gate electrode and the emitter an upwardly protruding equipotential line in the direction from the emitter toward the anode electrode, and a downwardly protruding equipotential line protruding away from the anode electrode, are both formed near the gate opening.

8. The electron emission device according to claim 7, wherein when a potential difference is provided between said gate electrode and said emitter, an upwardly protruding equipotential surface that does not extend beyond said first height toward said anode electrode is formed, and a dow-rnvardly protruding equipotential surface is formed between said first and said second height, in said gate opening.

9. The electron emission device according to claim 7, wherein said gate electrode further comprises a third gate electrode region having said first height.

* * * * *